US006719095B2

(12) United States Patent
Arens et al.

(10) Patent No.: US 6,719,095 B2
(45) Date of Patent: Apr. 13, 2004

(54) RAILROAD TRACK LUBRICATION AND MONITORING THEREOF

(75) Inventors: Thomas M. Arens, Florissant, MO (US); David C. Beck, St. Peters, MO (US); Paul G. Conley, St. Charles, MO (US); Ayzik Grach, Chesterfield, MO (US); Fred Leers, St. Louis, MO (US)

(73) Assignee: Lincoln Industrial Corporation, St. Louis, MO (US)

( * ) Notice: Subject to any disclaimer, the term of this patent is extended or adjusted under 35 U.S.C. 154(b) by 106 days.

(21) Appl. No.: 09/961,706

(22) Filed: Sep. 24, 2001

(65) Prior Publication Data

US 2002/0056592 A1 May 16, 2002

Related U.S. Application Data

(60) Provisional application No. 60/287,587, filed on Sep. 22, 2000.

(51) Int. Cl.[7] ..... B61K 3/00
(52) U.S. Cl. ..... 184/3.1
(58) Field of Search ..... 184/3.1, 34, 35; 137/625.17, 625.48, 625.69

(56) References Cited

U.S. PATENT DOCUMENTS

| | | | | |
|---|---|---|---|---|
| 2,152,696 A | | 4/1939 | Huck | |
| 2,168,554 A | * | 8/1939 | Bates | 184/3.1 |
| 2,223,714 A | * | 12/1940 | Bates et al. | 184/3.1 |

(List continued on next page.)

FOREIGN PATENT DOCUMENTS

| | | |
|---|---|---|
| FR | 1333636 | 6/1963 |
| GE | 921 946 | 1/1955 |
| WO | WO 00/61418 A1 | 10/2000 |

OTHER PUBLICATIONS

Richard P. Reiff and Scott Gage; "Lubrication: How much is enough?"; *Railway Age*; May 1999; pp. 59–60.
Portec Rail Products, Inc., Product Flyer: "Trackside Lubricant Applicators," Jan. 1998.
Portec Rail Products, Inc., Product Flyer: "Hydraulic Wayside Lubrication System" Jan. 1998.
Portec Rail Products, Inc., Product Flyer: "Protector® II Electronic Rail Lubricator," Sep. 1993.
Portec Rail Products, Inc., Product Flyer: "MC® Series Mechanical Wayside Lubrication System," Jan. 1998.
R. P. Reiff; "Acceptance tests for AAR Lubrication Research Vehicle"; *Lubrication Engineering*; Apr. 1987; vol. 43, pp. 266–272.
KLS Lubriquip, Inc., IDEX Corporation: "Trackmaster Rte 25 Rail Flange Lubricator" Jan. 1996.
Manual: Section III—"Rail Wear & Lubrication," Undated but Admitted Prior Art; pp. 29–36.

*Primary Examiner*—Chong H. Kim
(74) *Attorney, Agent, or Firm*—Senniger, Powers, Leavitt & Roedel

(57) ABSTRACT

Wayside lubrication apparatus for railroad track wherein metered charges of lubricant are delivered to points spaced at intervals along the gage sides of the heads of the rails, and systems for and methods of monitoring the apparatus at a location remote from the site thereof.

45 Claims, 33 Drawing Sheets

U.S. PATENT DOCUMENTS

| | | | | | |
|---|---|---|---|---|---|
| 2,231,394 | A | * | 2/1941 | Reece | 184/3.1 |
| 2,401,303 | A | * | 6/1946 | Huber | 184/3.1 |
| 2,489,182 | A | | 11/1949 | Huck | |
| 2,518,786 | A | * | 8/1950 | Huck | 184/3.1 |
| 2,884,093 | A | * | 4/1959 | Stewart | 184/3.1 |
| 2,907,410 | A | * | 10/1959 | Stokes | 184/3.1 |
| 2,929,466 | A | * | 3/1960 | McWilliams | 184/3.1 |
| 2,995,209 | A | * | 8/1961 | Magnus | 184/3.1 |
| 2,995,210 | A | * | 8/1961 | Stemberger | 184/3.1 |
| 3,059,724 | A | | 10/1962 | Soule, Jr. | |
| 3,147,822 | A | * | 9/1964 | Watts | 184/3.1 |
| 4,088,078 | A | | 5/1978 | Noble | |
| 4,186,821 | A | | 2/1980 | Wegmann | |
| 4,214,647 | A | * | 7/1980 | Lutts | 184/3.1 |
| 4,334,596 | A | * | 6/1982 | Lounsberry, Jr. | 184/3.1 |
| 4,346,785 | A | * | 8/1982 | Frank | 184/3.1 |
| 4,811,818 | A | | 3/1989 | Jamison | |
| 5,054,582 | A | | 10/1991 | Aracil | |
| 5,076,396 | A | | 12/1991 | Foote | |
| 5,348,120 | A | | 9/1994 | Junk et al. | |
| 5,394,958 | A | * | 3/1995 | Junk et al. | 184/3.1 |
| 5,497,852 | A | | 3/1996 | Little et al. | |
| 5,518,085 | A | | 5/1996 | Houser, Jr. et al. | |
| 5,641,037 | A | * | 6/1997 | Wise et al. | 184/3.1 |
| 5,687,814 | A | | 11/1997 | Craig et al. | |
| 6,446,754 | B1 | * | 9/2002 | Kostelny-Vogts et al. | 184/3.1 |

* cited by examiner

— — — FIELD CONNECTIONS

* CONNECTIONS TO ENCLOSURE DOOR

RAILROAD TRACK LUBRICATION AND MONITORING THEREOF

CROSS-REFERENCE TO RELATED APPLICATION

This application claims the benefit of U.S. Provisional Application No. 60/287,587, converted from application Ser. No. 09/667,384, filed Sep. 22, 2000.

BACKGROUND OF THE INVENTION

This invention relates to railroad track lubrication and monitoring thereof; more particularly to what may be referred to as wayside lubrication, i.e. lubrication of the rails of the track by apparatus including means on the rails (as distinguished from railroad-train-mounted lubricators), and the remote monitoring thereof.

The invention is especially concerned with apparatus for applying lubricant to the rails of a railroad track ahead of a curve in the track (and ahead of other stretches of the track where lubrication may be called for, e.g., such as a stretch of track before a switching station) for the well known purpose of reducing friction between the flanges of the wheels of a railroad train and the insides (i.e., gage sides) of the heads of the rails of the track as the train negotiates the curve (or other stretch) in order to reduce wear on the rails and the wheels as well as to reduce the consumption of fuel or electrical power by the train. This invention is also directed to the monitoring of such apparatus at locations remote therefrom.

Reference may be made to the following United States patents relating to wayside lubrication means for background, the present invention having been developed for improvement over the apparatus such as shown therein: U.S. Pat. Nos. 5,394,958, 5,518,085, 5,641,037 and 5,348,120.

SUMMARY OF THE INVENTION

Among the several objects of the invention may first be noted broadly the provision of improved apparatus for wayside lubrication of the rails of railroad track; the provision of such apparatus for application of lubricant to the heads of the rails of railroad track as a train travels into a curve or other stretch at points spaced along the length of the rails with relatively uniform distribution of the lubricant to said points avoiding over-lubrication at some points and under-lubrication at others; the provision of apparatus comprising means readily mounted on rails in the field and adapted for said relatively uniform distribution of lubricant; the provision of a system for supplying to such apparatus relatively viscous lubricants (e.g. relatively thick grease) even in cold weather; the provision of such a system which, even as installed in remote locations, has relatively low service and low maintenance requirements and long life; the provision of such a system which includes a battery-powered electric-motor-driven pump (as distinguished from a train-wheel-actuated pump) for pumping lubricant for the distribution thereof, which is adapted for installation in locations where electric power is not readily available, and which is operable without servicing for battery recharge; the provision of such a system adapted for installation where electric power is available; and the provision of a system for monitoring the lubrication apparatus at locations remote from the apparatus.

In one aspect thereof, the invention comprises an elongate applicator for attachment to a railroad rail on the inside of the rail extending lengthwise of the rail, the applicator having a plurality of lubricant metering devices thereon. Each of the devices is operable in response to delivery thereto of lubricant under pressure to deliver a metered charge of lubricant and to become charged for a subsequent delivery of a metered charge. The metered charges delivered by the devices are delivered to points spaced at intervals along the length of the applicator with the delivery such as to apply the delivered charges to the inside of the head of the rail to which the applicator is attached.

A feature of the invention involves the inclusion of an elongate mounting bar and means at each end of the mounting bar mounting an elongate applicator in position extending lengthwise of the rail on the inside thereof, each such means comprising a first rail flange clamp jaw engaging the inside edge of the flange and a second rail flange clamp jaw engaging the outside edge of the flange, said jaws being drawn together for the clamping thereof on the flange, and a support for the mounting bar on the first jaw.

In another aspect, the invention comprises at least one applicator on the inside of each rail of railroad track for delivery of lubricant to the inside of the heads of the rails from a container for holding a supply of lubricant alongside the track. A pump for pumping lubricant from the container to the applicators is driven by an electric motor connected in an electrical circuit responsive to passage of a train on the track for operation of the motor to drive the pump.

In a further aspect, the invention involves lubricating apparatus for two adjacent railroad tracks, a first and a second track comprising at least one lubricant applicator on the inside of each rail of the two tracks for delivery of lubricant to the insides of the heads of the rails of the tracks. A pump pumps lubricant from a container adjacent the tracks to the applicators for the rails of one track responsive to passage of a train on the first track, pumps lubricant from the container to the applicators for the rails of the second track responsive to passage of a train on the second track, and pumps lubricant from the container to the applicators for the rails of both tracks responsive to passage of trains on both tracks.

In yet another aspect, the invention comprises a method of and system for the monitoring of wayside lubrication apparatus at a location remote from the site thereof involving the monitoring on site of the apparatus of at least one parameter (e.g., completion of a cycle of operation of the apparatus) and loading data relating to the parameter in a controller on the site for receiving and transmitting the data, and transmitting the data from the controller to a computer at the remote location enabling observation of the data thereat.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
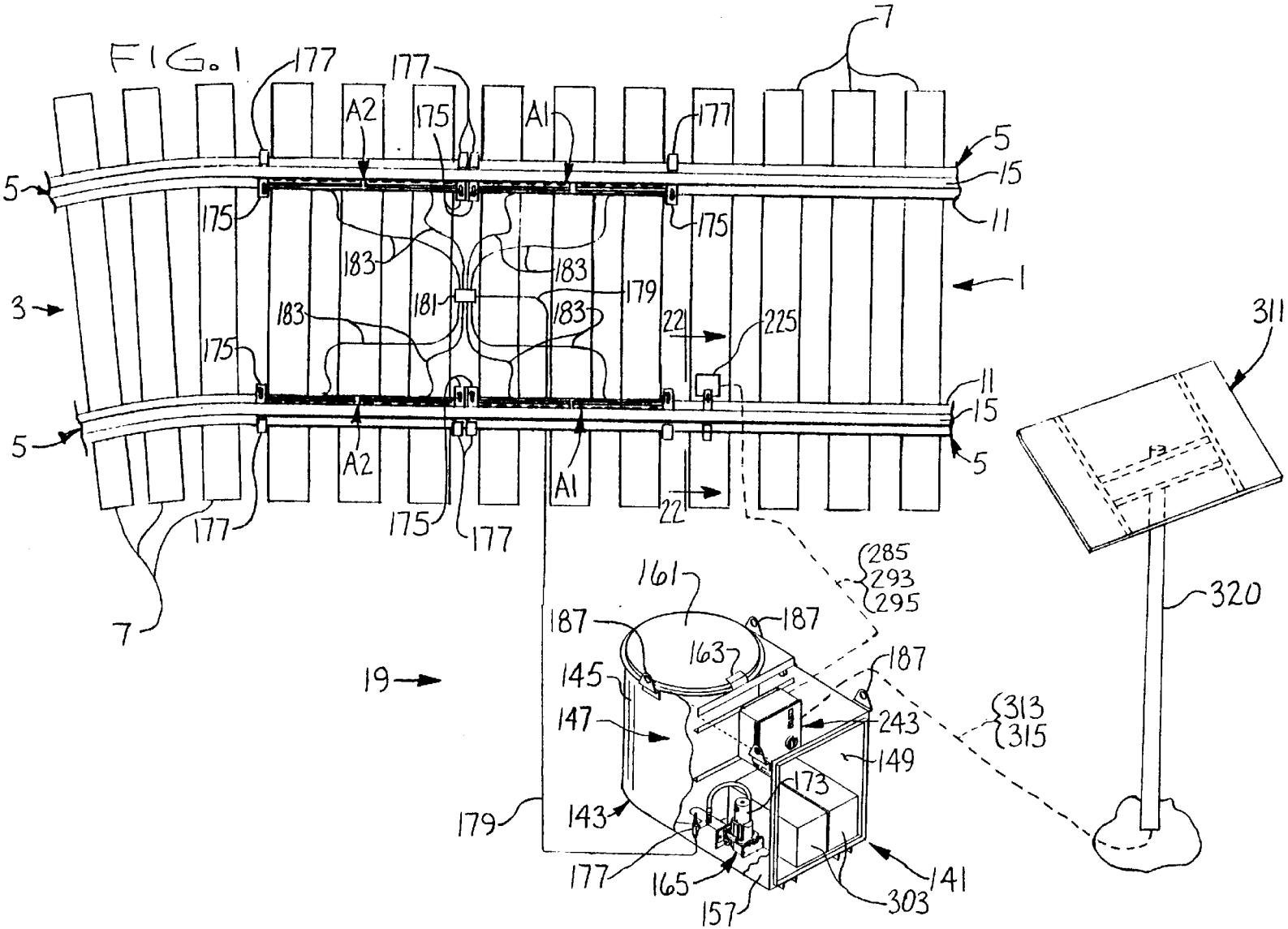
FIG. 1 is a view partly in plan and partly in perspective of a lubrication system of this invention for the heads of the rails of a single railroad track, showing two lubricant applicators or "wiper bars" on each of the rails (four in all), those parts which are in perspective being on a smaller scale and partly broken away.

Referring to the drawings, FIG. 1 shows a straight stretch 1 of railroad track leading into a curved stretch 3, the track comprising the usual railroad rails 5 fastened on the usual ties 7 laid, for example, on the usual ballast (not illustrated). Each rail is a steel rail of usual cross-section (see FIGS. 4 and 5, particularly) comprising a flange 11 fastened on the ties in the usual manner by spikes (not shown), a web 13 extending up from the flange and a head 15 on the web 13. As the rails are placed (parallel to one another) to form the track, their heads 15 have inside (gage side) faces 17. Referring to FIG. 1, at 19 is generally indicated a lubrication system of this invention for applying lubricant to the said inside faces 17 of the heads of the rails in the straight stretch 1 of track ahead of the curve at 3 at a plurality of points providing lubrication between the flanges of the wheels of a train and the inside faces 17 as the train negotiates the curve at 3 in order to reduce friction between the flanges and the rail heads. System 19 is partially illustrated in FIG. 1A. FIGS. 2–5 illustrate a rail 5 and a wheel 21 of a train riding on the rail with the flange 23 of the wheel on the inside of the rail head; FIG. 5 shows lubricant L between the wheel flange and rail head.

In many situations, the straight stretch 1 is a stretch between two not-too-distant curved stretches (only the one curved stretch 3 being illustrated in FIG. 1) and the system serves not only to lubricate the rails ahead of the curved stretch 3 as a train travelling in the direction from right to left in FIG. 1 heads into curved stretch 3 but also serves to lubricate the rails of the other (not shown) curved stretch as a train travelling in the opposite direction heads into said other curved stretch.

System 19 comprises two lubricant applicators, which may also be referred to as wiper bars, extending lengthwise of each of the two rails of the track in tandem, one following the other, the first of the two being designated A1, the second A2. Each of these applicators or wiper bars (four in all, two on one rail directly across from two on the other rail) is mounted on the inside 27 of the respective rail for application of lubricant to the inside face 17 of the respective rail head at points spaced at intervals (e.g., 1.5–2.3 inch intervals) therealong. As will be subsequently detailed, each applicator or wiper bar A1, A2 is operable in cycles to apply a metered charge of lubricant on each cycle at each of a multiplicity of points spaced at intervals along the length of the respective rail head.

Referring particularly to FIGS. 2–8, the lubricant applicator or wiper bar A1 comprises an elongate body 29 (FIG. 5) which, as mounted on the inside 27 of the respective rail and attached thereto, has a face 31 facing toward the rail and an opposite face 33 facing away from the rail, being attached to the respective rail on the inside 27 of the respective rail in a manner to be subsequently described. Body 29 comprises an elongate mounting bar 35 adapted for attachment to a rail (by means to be subsequently described) extending lengthwise of the rail on the inside thereof, with one of the relatively wide faces of the bar (said face being indicated at 37 in FIG. 5) facing toward the rail and the other (indicated at 39) facing away from the rail. Extending lengthwise of the mounting bar 35 in tandem on face 39 thereof are first and second lubricant distributors D1 and D2 (FIG. 7) each having passages (to be subsequently described in detail) therein for delivery of metered charges of lubricant to the aforesaid points of lubrication.

Figure 6:
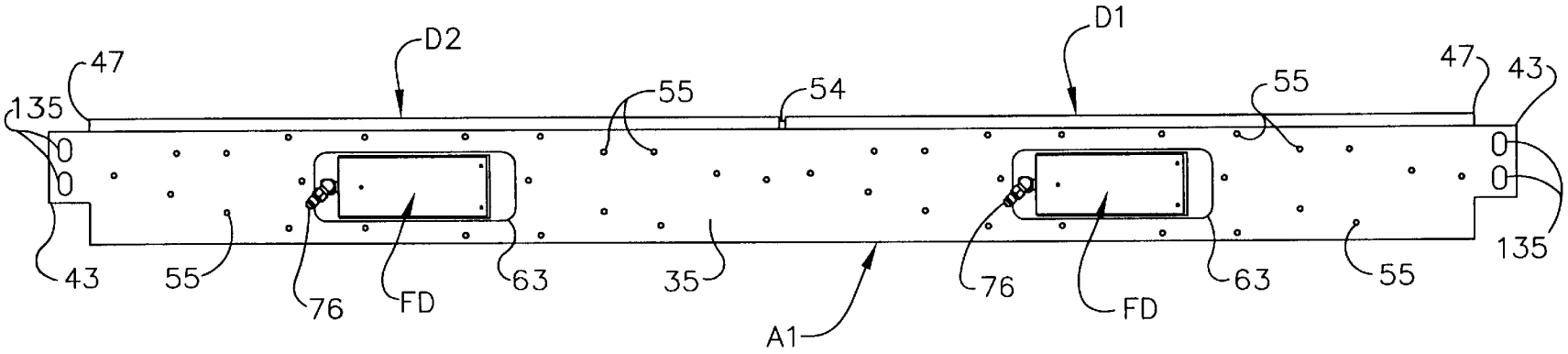
FIG. 6 is a view in elevation of the side of one of the applicators which faces the rail to which it is applied, certain parts being omitted for clarity.
Figure 7:
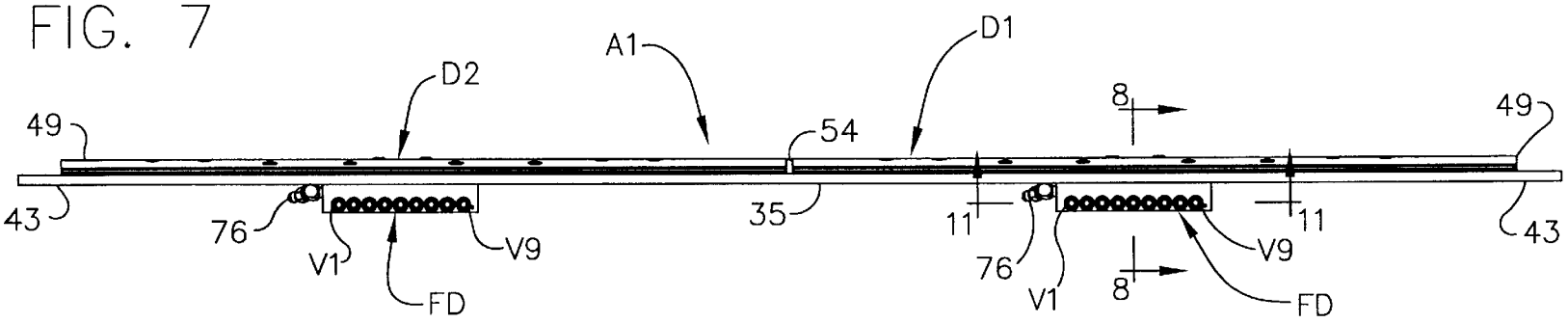
FIG. 7 is a view in plan of FIG. 6.
Figure 8:
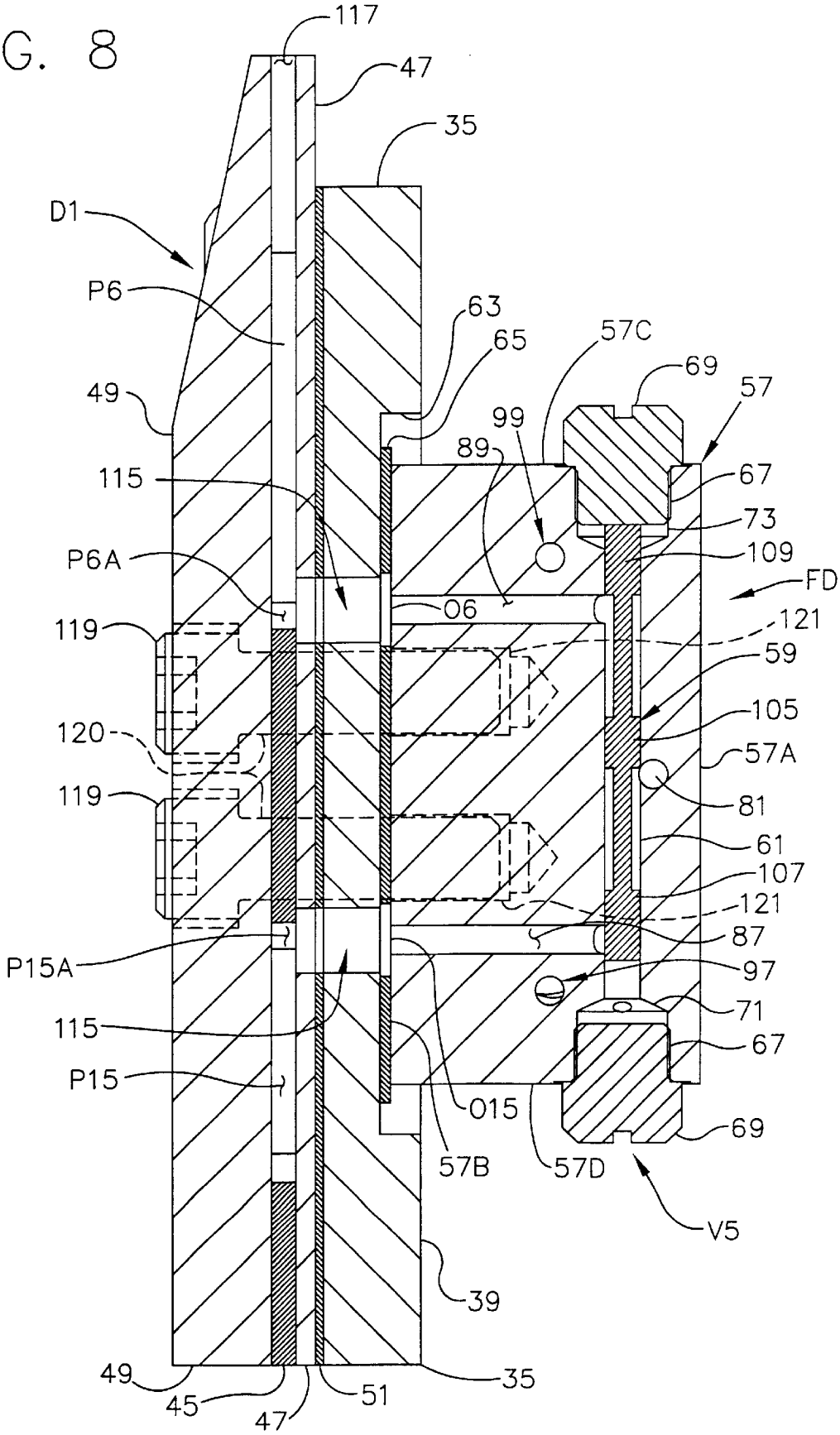
FIG. 8 is a view in enlarged vertical section taken generally on line 8—8 of FIG. 7.
Figure 9:
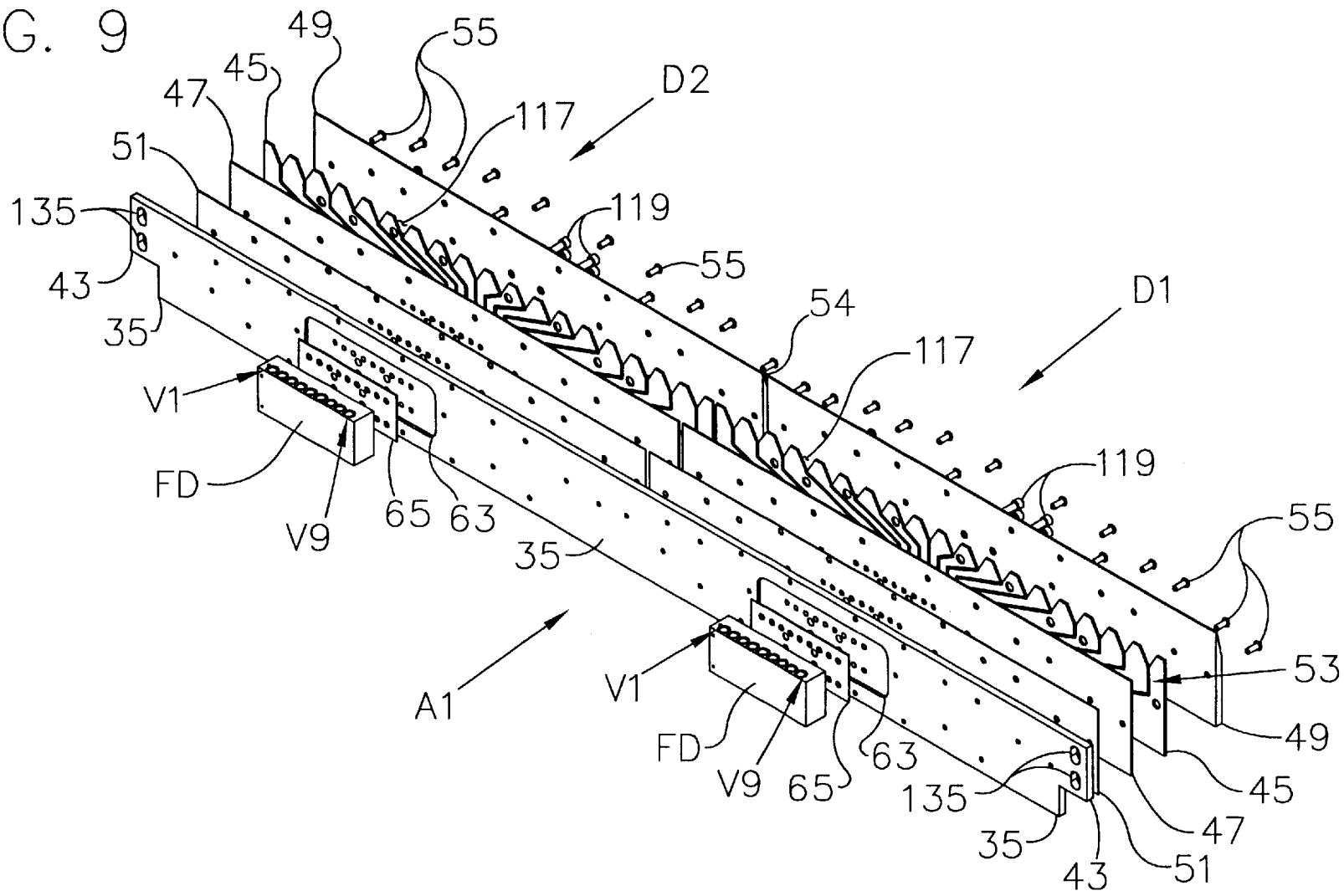
FIG. 9 is a view in exploded perspective of an applicator.

The elongate mounting bar 35 is somewhat longer than twice the length of either of the two elongate distributors, having end portions each designated 43 extending beyond the distributors (see FIGS. 6 and 7). As shown particularly in FIGS. 8–10, each of the distributors D1 and D2 comprises a plate 45, which may be referred to as the manifold plate, somewhat less than half the length of the mounting bar, having a set of slots (to be subsequently described in detail) sandwiched between a spacer plate 47 and a closure plate 49 (enclosing the slots), each of the same length as the manifold plate 45. The slots in the latter constitute the passages in the distributor, each set thereof being designated 53 in its entirety. Thus, each distributor comprises plates 45, 47 and 49 held in laminated assembly on the face 39 of the mounting bar 35 extending lengthwise thereof with a gasket 51 interposed between plate 47 and the mounting bar. The two distributors D1 and D2 are secured to the mounting bar 35 in tandem, i.e., one extending for somewhat less than half the length of the mounting bar on one half the length of the mounting bar, the other extending for somewhat less than half the length of the mounting bar on the other half of the mounting bar, with a gap 54 between the inner ends of the two distributors. Securement is by screws as indicated at 55 (FIG. 6). To prevent leakage, the plate 45 can be of a compressible, gasket-type material. Alternatively, the plate 45 can be a metal plate with gaskets provided on opposite sides of the plate to seal against plates 47 and 49.

Figure 10:
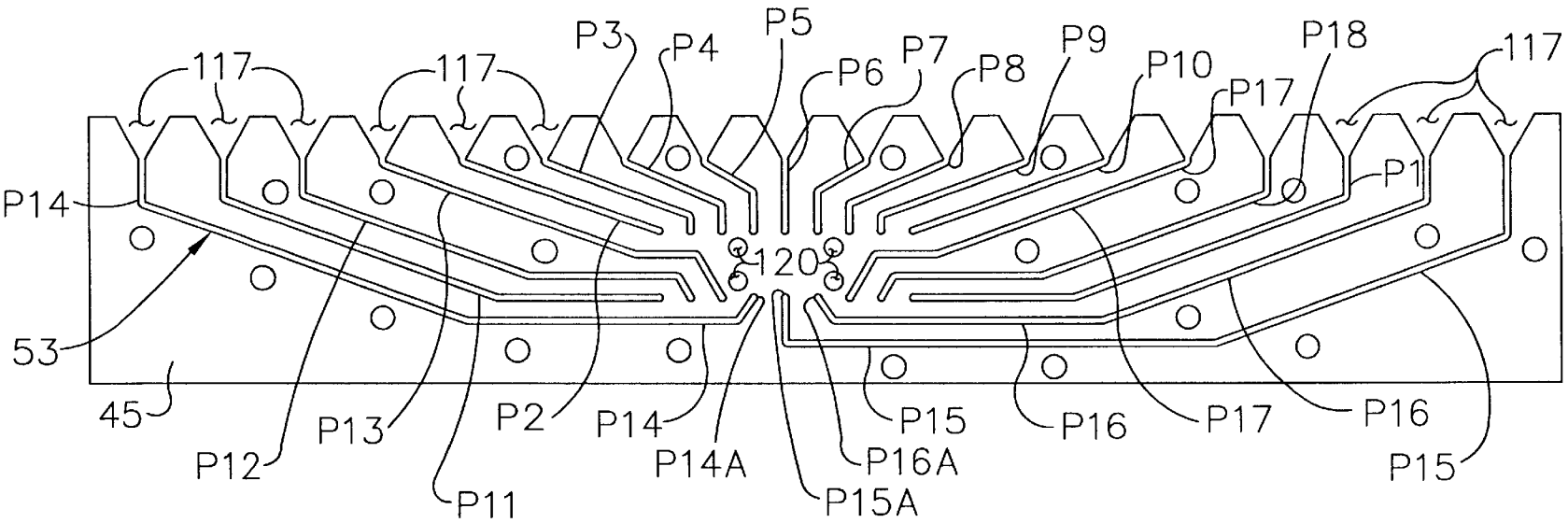
FIG. 10 is a view in elevation of a slotted plate of the applicator.

Referring more particularly to FIG. 10, each set 53 of passages formed by the slots in each of the manifold plates 45 is shown as a set of eighteen passages (formed by eighteen slots) designated P1–P18, for the delivery of metered charges of lubricant to the inside 17 of the head 15 of a rail 5 at eighteen points of lubrication spaced at intervals (e.g. spaced at 1.5 inch intervals) along the length of the rail head. With the manifold plate 45 of each distributor providing the set 53 of eighteen passages, the distributor (D1) is adapted to apply the metered charges of lubricant over a distance of about 27.5 in., for example, corresponding to about one-fourth the circumference of a typical railroad vehicle wheel. Thus, with two applicators (A1 and A2) and thus four distributors (D1 and D2 of A1 and D1 and D2 of A2) in tandem on each track, metered charges of lubricant are applied over a first distance generally one-half the wheel circumference and immediately thereafter over a second distance generally one-half the wheel circumference, the sum total of the distances generally equaling the wheel circumference. It will be understood that the number of passages in each set 53 may vary without departing from the scope of this invention. For example, twelve passages (slots) may be used instead of the eighteen shown, in which case the spacing between the slots could be 2.3 in. instead of 1.5 in.

Each of the two distributors D1, D2 of each applicator A1 further comprises a lubricant flow divider designated FD for servicing set 53 of passages thereof. Each flow divider is mounted on the inside face 37 of a receptive mounting bar 35 in a manner to be described, each of said flow dividers being generally centered in relation to the length of a respective slotted manifold plate 45. One of the two flow dividers is spaced about one-quarter the length of applicator A1 in from one end of the applicator, the other being spaced about one-quarter the length of the applicator in from its other end.

Figure 11:
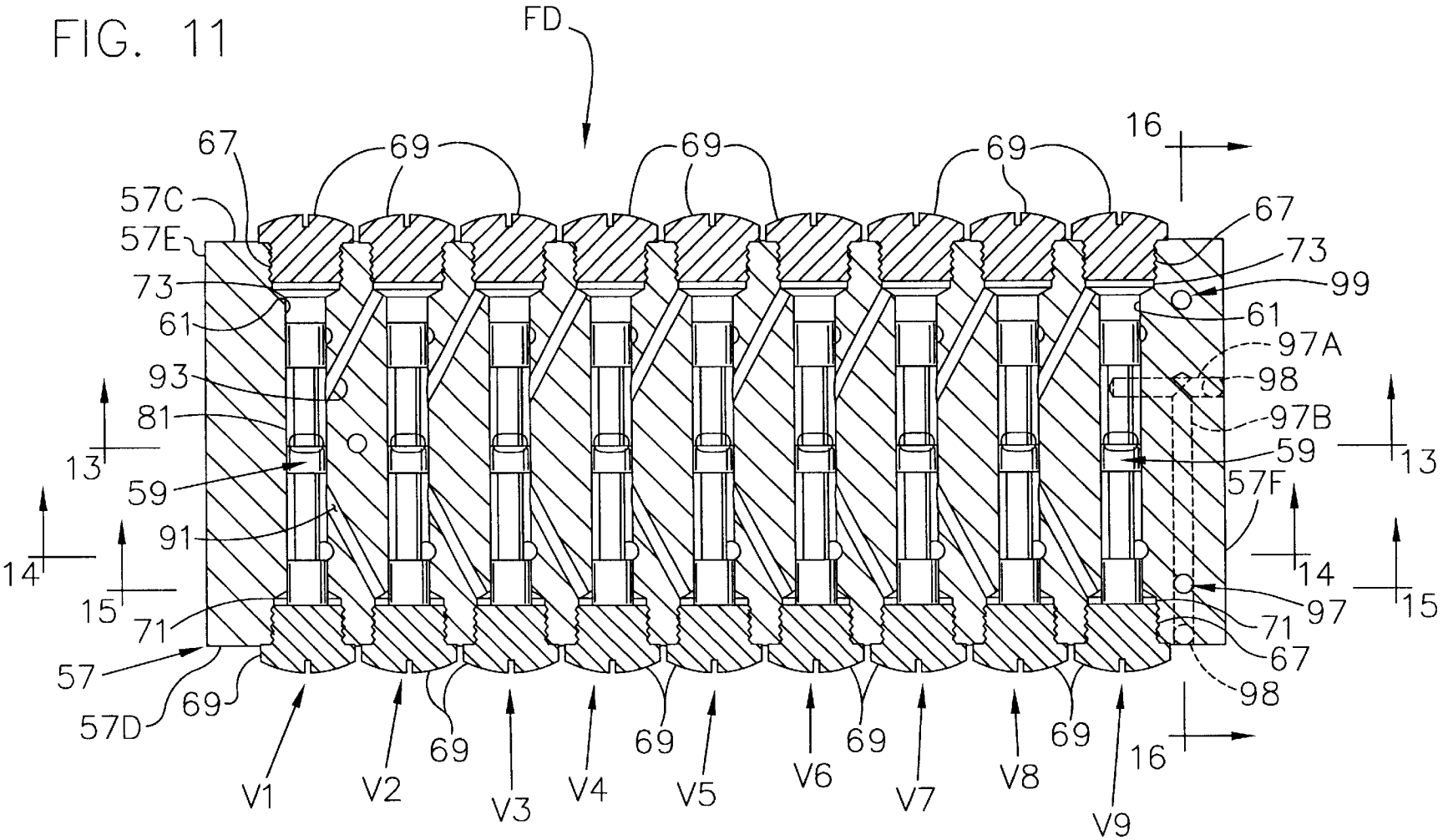
FIG. 11 is a view in enlarged section of a flow divider generally on line 11—11 of FIG. 7.
Figure 12:
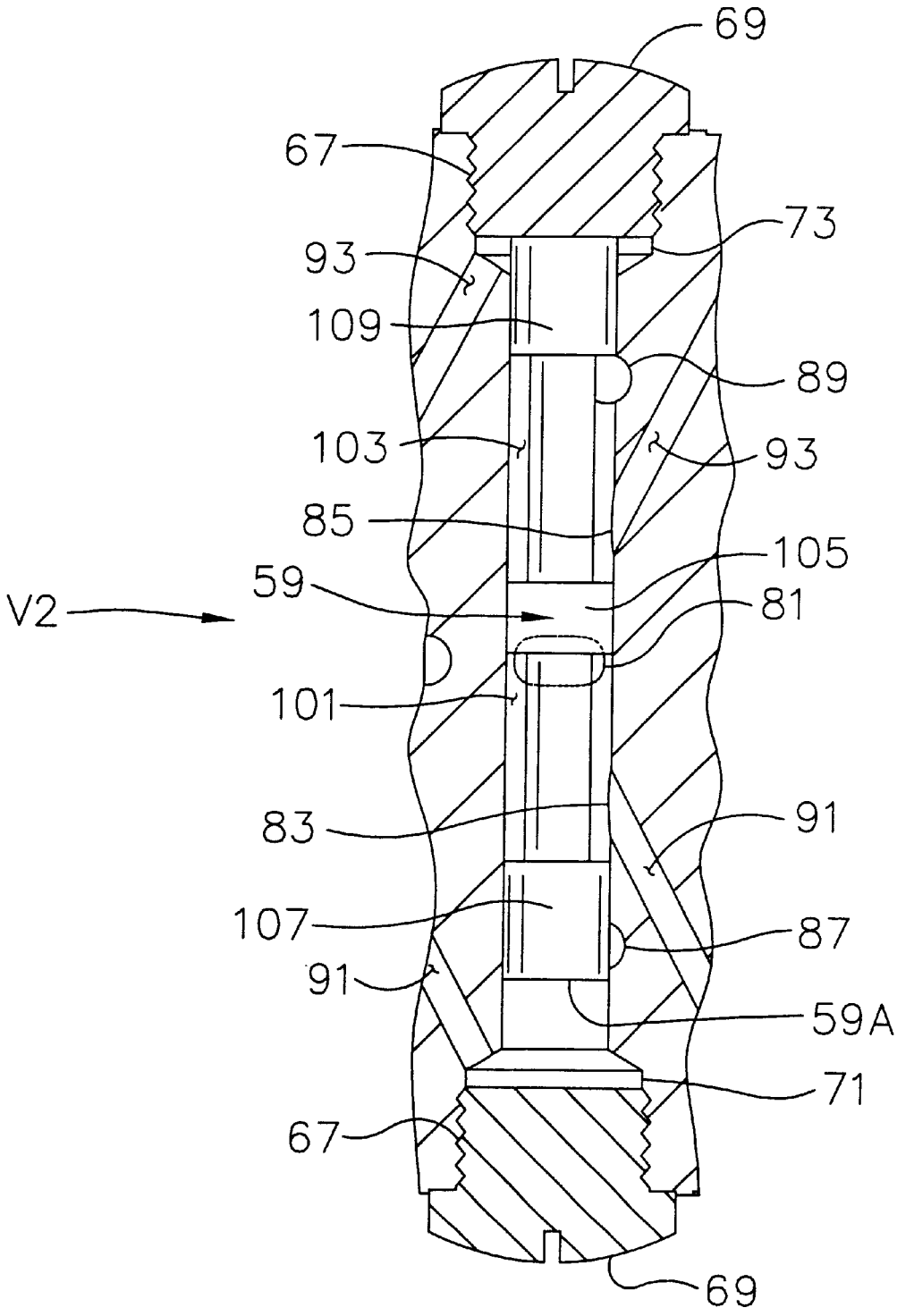
FIG. 12 is a view of the divider valve of FIG. 11A showing a moved position of a spool of said valve.

Each of the flow dividers FD (they are identical) is adapted as will be subsequently described in detail to divide a flow (an input) of lubricant under pressure supplied thereto into a plurality (eighteen as herein illustrated) of metered charges of the lubricant for the distribution thereof via the respective set 53 of passages. Each flow divider comprises a plurality of divider valves (nine in all as herein illustrated) generally designated V1–V9 in a valve block 57. These divider valves are similar to those shown in co-assigned U.S. Pat. No. 4,186,821 of Jerome B. Wegmann issued Feb. 8, 1980 entitled Lubricating Apparatus, and co-assigned U.S. Pat. No. 5,497,852 of John Little, Jeffrey Kotyk and James B. Grove, issued Mar. 12, 1996 entitled Automatic Lubrication Apparatus, both of these patents being incorporated herein by reference. Referring principally to FIGS. 11 and 12, each divider valve V1–V9 of each flow divider FD of each applicator A1 comprises an elongate rod-like valve member termed a piston member or preferably termed a spool, generally designated 59, axially slidable in a bore 61 in the valve block 57 between a first position in the bore in which all nine spools are illustrated in FIG. 11 (their lowered position) and a second position (the raised position) illustrated in FIG. 12 in which the spool of one of the valves is axially displaced from the first position. The block 57 is generally a rectangular parallelepiped (i.e. shaped like a brick), its long relatively wide rectangular faces being designated 57*a* and 57*b* (see particularly FIG. 18), its relatively long narrow rectangular faces being designated 57*c* and 57*d*, and its rectangular end faces being designated 57*e* and 57*f*. Each of the flow dividers FD of applicator A1 is mounted on the face 37 of the mounting bar 35 in generally centered position relative to the respective distributor in a recess 63 (FIG. 9) in bar 35 with face 57*b* against a gasket 65, with face 57*c* uppermost and face 57*d* lowermost. The bores 61 (nine in all) extend generally parallel to one another between the upper face 57*c* and the lower face 57*d* in a plane adjacent the face 57*a* of the block spaced at generally equal intervals lengthwise of the block. Each of the upper and lower ends of each of bore is counterbored as indicated at 67 (FIG. 11) and closed by a plug 69 threaded therein, the plugs closing the ends of the bores in such manner that there are lower and upper chambers 71 and 73 at the ends. The stated first (lowered) position of each valve spool 59 is determined by engagement of its lower end 59*a* with the lower end plug and the stated second (raised) position of each valve spool is determined by engagement of its upper end 59*b* with the upper end plug.

Figure 13:
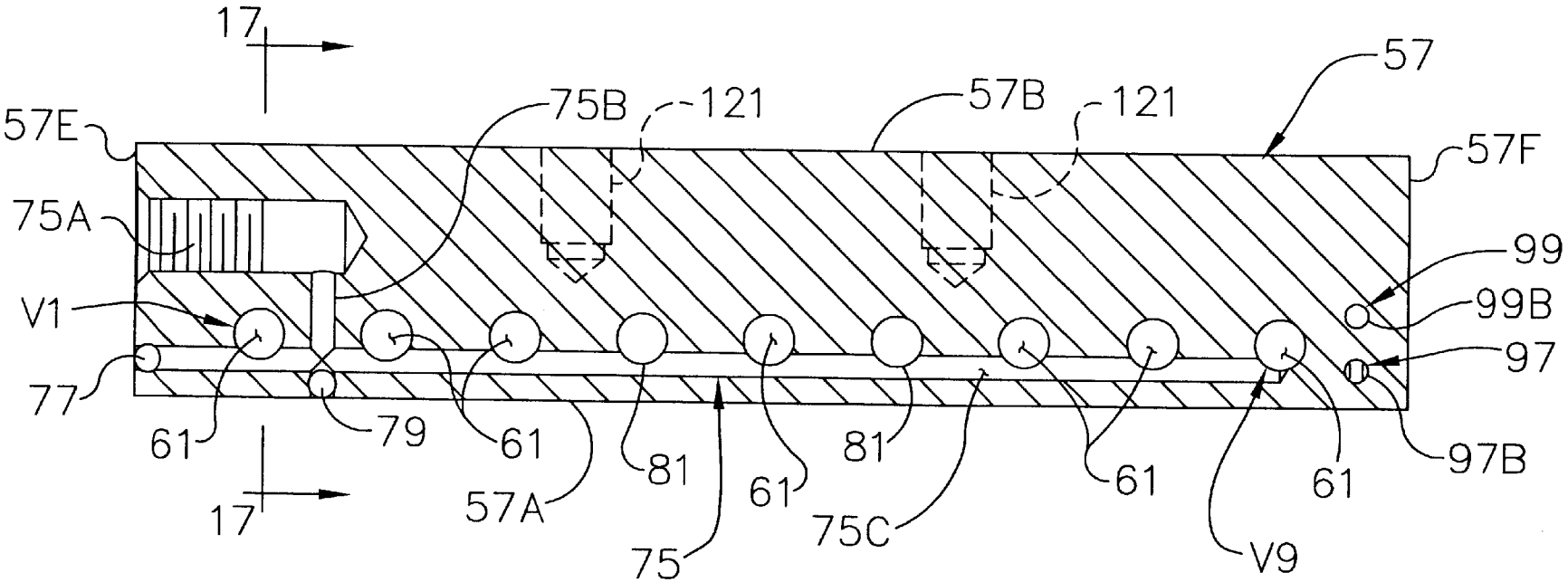
FIG. 13 is a view in section generally on line 13—13 of FIG. 11.

Referring primarily to FIG. 13, indicated in its entirety by the reference numeral 75 is passaging in the FD block 57 for delivery of lubricant to the nine bores 61, said delivery passaging 75 comprising a relatively short entry passage 75*a* drilled into the block 57 from its end face 57*e*, and a passage 75*b* extending transversely from the entry passage 75*a* to a long manifold passage 75*c* which extends endwise of the block and intersects all nine bores 61. Passage 75*c* is formed by drilling a long hole in the block 57 from its end 57*e* to the V9 bore intersecting the nine bores tangentially and plugging the 57*e* end of the hole as indicated at 77. Passage 75*b* is formed by drilling a short hole in the block 57 from face 57*a* to hole 75*a* and plugging the end thereof as indicated at 79. The entry passage 75*a* is tapped for threaded connection of a fitting 76 (see FIGS. 6 and 7) for connection of a lubricant hose line for delivery of lubricant under pressure to the long manifold passage 75*c* and thence to the bores 61. The intersection of the long manifold passage and each bore constitutes an inlet port 81 for admission of lubricant from the manifold passage 75*c* to the bore 61 generally midway (i.e., at the center of the length) of the bore. Each bore 61 has two transfer ports 83 and 85 located in planes transverse to the bore on opposite sides of the respective inlet port 81 a relatively short distance therefrom (see particularly FIGS. 11A and 12). Each bore also has two outlet passages 87 and 89 extending generally tangentially therefrom at points between the transfer ports 83 and 85 and the ends of the bore 61, said outlet passages extending to outlets (to be subsequently detailed) in the face 57*b* of the block. Extending from the transfer port 83 of each of valves V1-V8 to the chamber 71 of the bore of valves V2–V9 is a lubricant transfer passage 91, and extending from the transfer port 85 of each of valves V1–V8 to the chamber 73 of the bore of valves V2–V9 is a lubricant transfer passage 93. These transfer passages (and ports 83, 85 of valves V1–V8) are formed by drilling holes in the block 57 (before the plugs are applied) extending at angles in the block from the chambers 73 and 71 of the V2–V9 bores to the V1–V8 bores. The holes forming the transfer passages 91 and 93 are all in the vertical plane of the series of bores.

Figure 14:
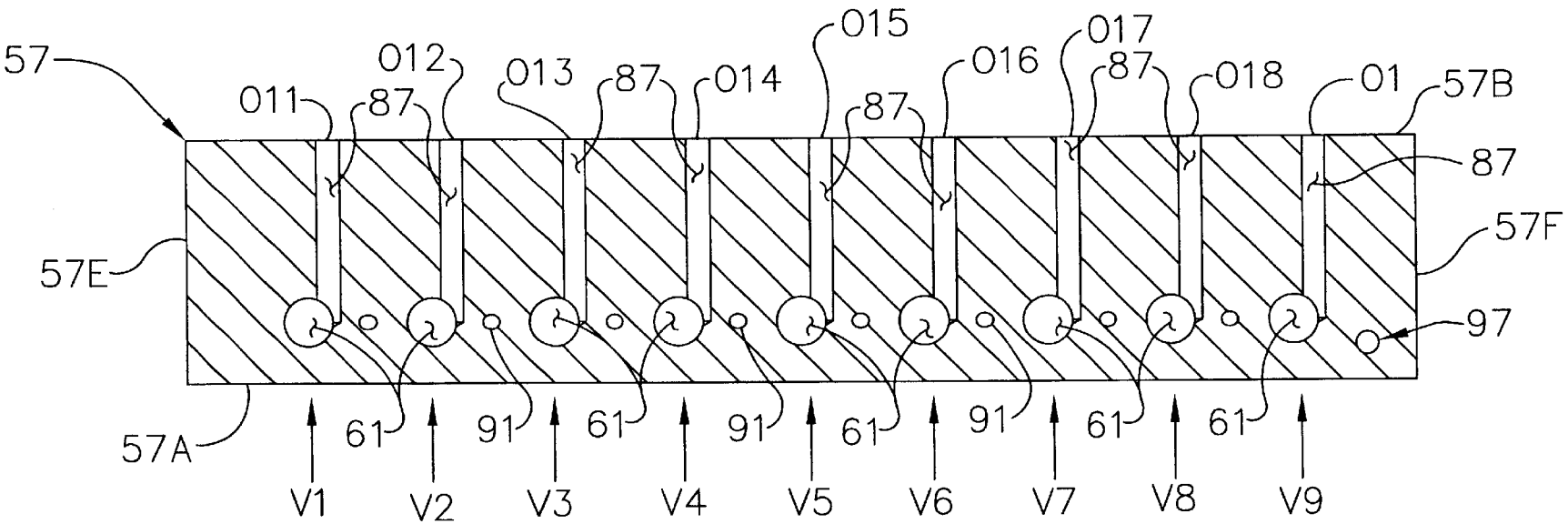
FIG. 14 is a view in section generally on line 14—14 of FIG. 11.
Figure 15:
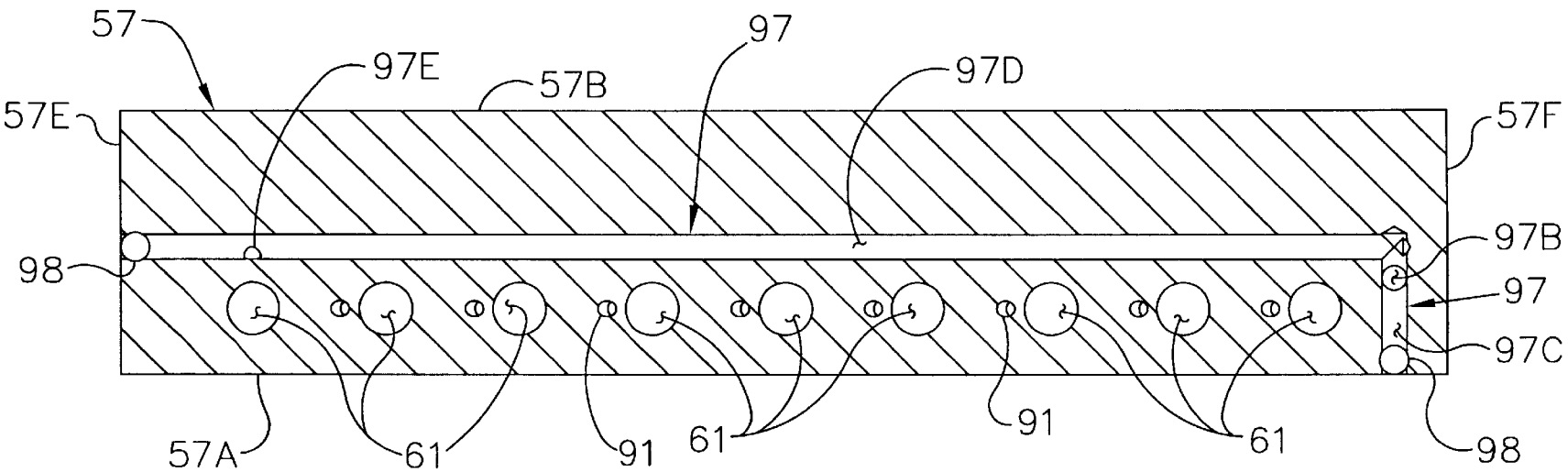
FIG. 15 is a view in section generally on line 15—15 of FIG. 11.
Figure 16:
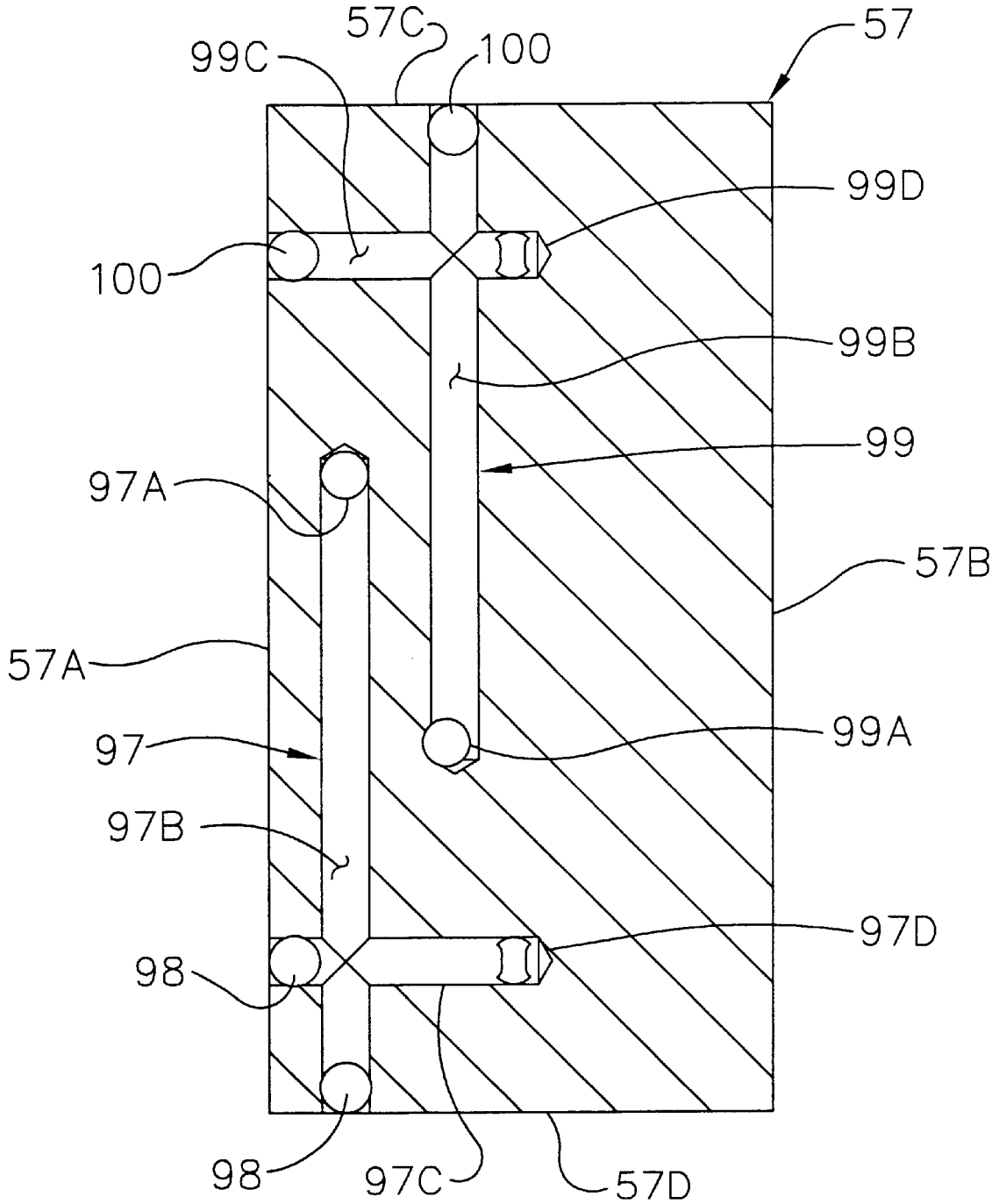
FIG. 16 is a view in section generally on line 16—16 of FIG. 11.
Figure 17:
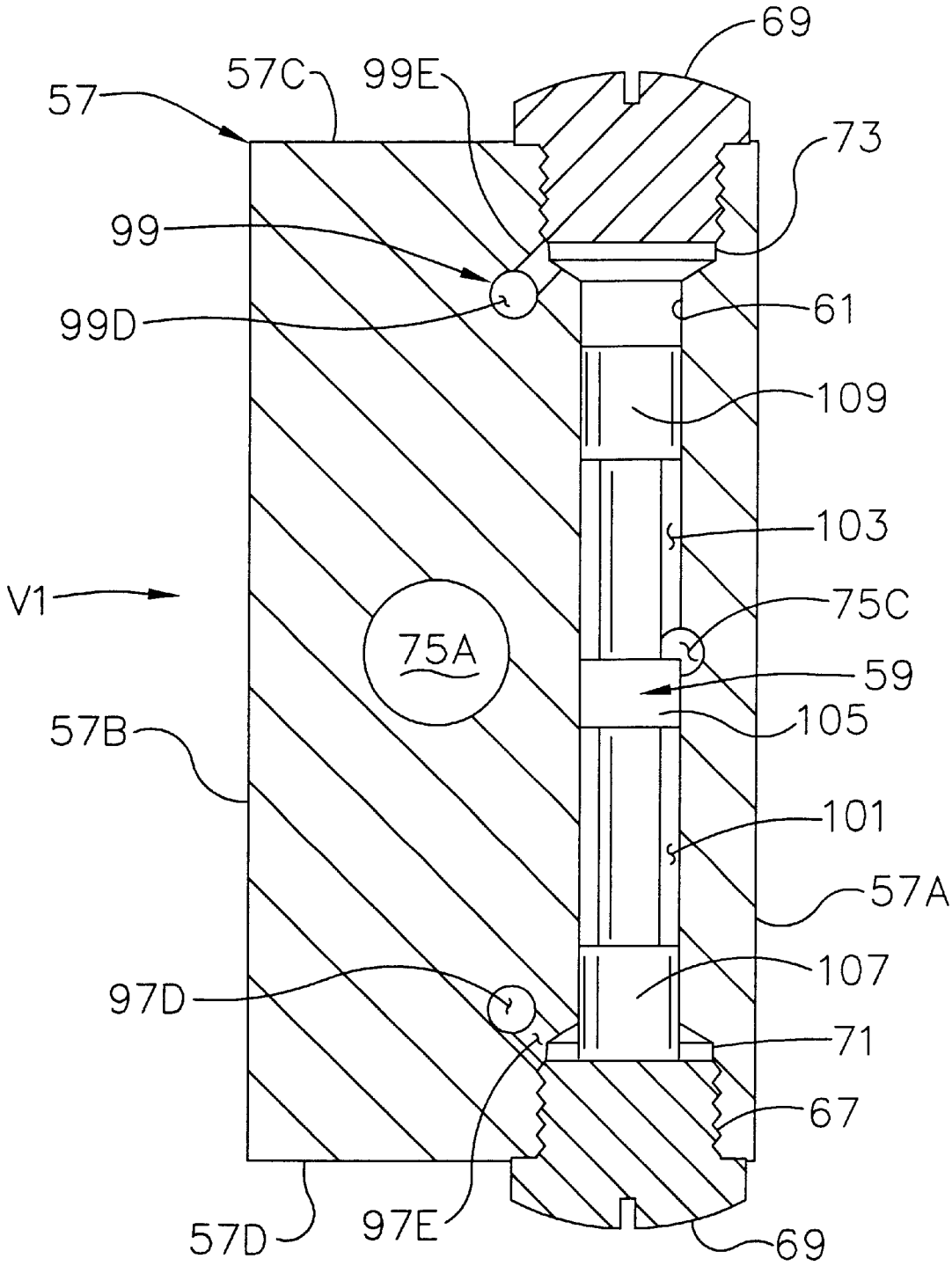
FIG. 17 is an enlarged section generally on line 17—17 of FIG. 13.
Figure 18:
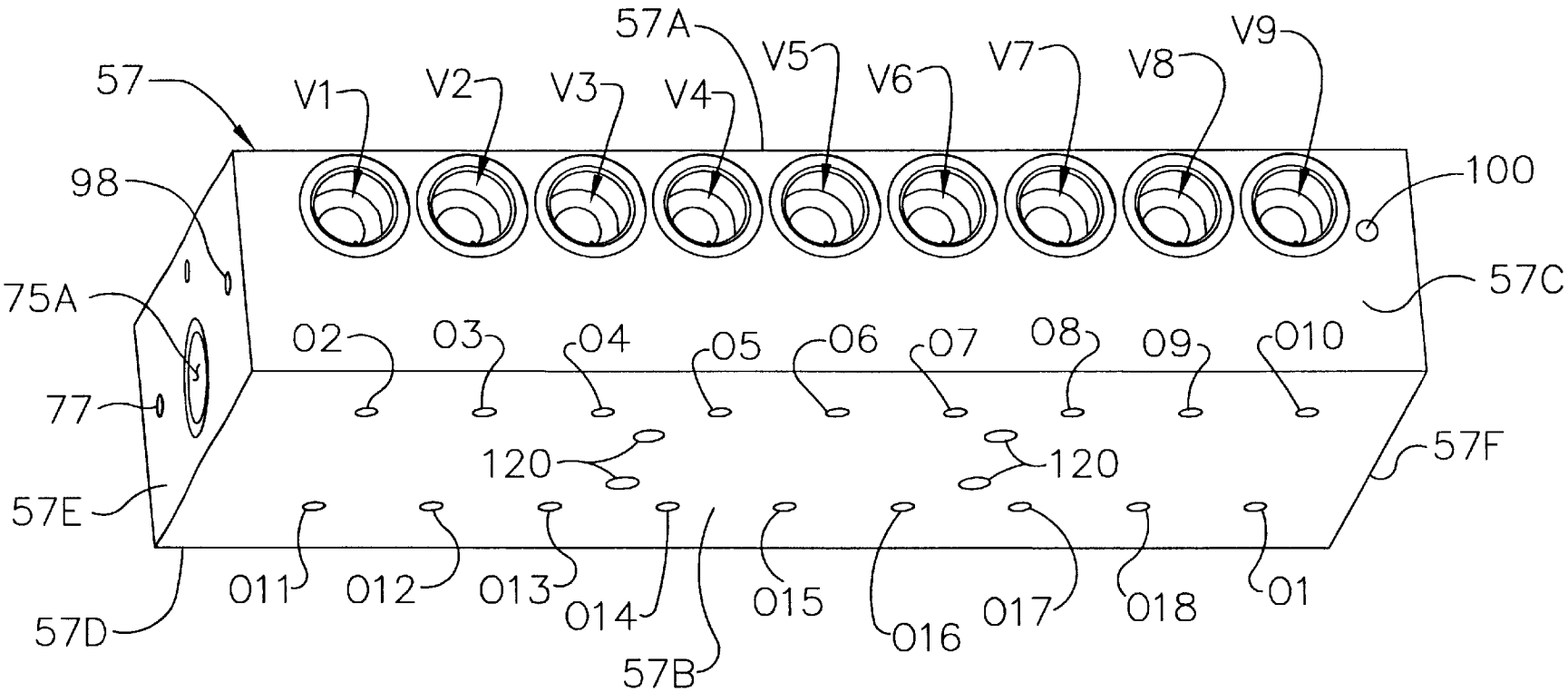
FIG. 18 is a perspective of the flow divider oriented for illustration of outlets in a face thereof, certain plugs being omitted.

With nine bores 61 each having the two outlet passages 87 and 89, the block 57 has eighteen outlets, each identified by the letter O and a numeral from 1 to 18 significant of the sequence of delivery of the metered charges therefrom (see particularly FIGS. 14 and 18). The flow divider FD functions on a cycle thereof (initiated on pressurization of the supply of lubricant thereto) first to deliver a metered charge of lubricant first from outlet 01, then to deliver a metered charge from outlet 02, 03 etc. ending the cycle with delivery of the eighteenth metered charge from outlet 018. Upon each repeat of pressurization, the cycle is repeated. Referring particularly to FIG. 18, it will be observed that the outlets 01–018 occupy a pattern in which there are in effect nine pairs of outlets, one pair for each of valves V1–V9, each pair comprising an upper and a lower outlet, the pairs being disposed in side-by-side relation. Valve V1 has the pair 02 and 011, V2 the pair 03 and 012, V3 the pair 04 and 013, V4 the pair 05 and 014, V5 the pair 06 and 015, V6 the pair 07 and 016, V7 the pair 08 and 017, V8 the pair 09 and 018, and V9 the pair 010 and 01.

Referring particularly to FIGS. 11 and 15–17, a transfer passage indicated in its entirety by the reference numeral 97 interconnects the transfer port 85 of valve V9 with chamber 71 of valve V1. This passage 97 is formed by holes drilled in block 57 as follows: hole 97*a* drilled from end 57*f* of the block to port 85 of valve V9; hole 97*b* drilled from the bottom face 57*d* of the block to hole 97*a,* outward of and parallel to the bore 61 of valve V9; hole 97*c* drilled from face 57*a* of the block intersecting hole 97*b;* long hole 97*d* drilled from the end 57*e* of the block all the way to hole 97*c;* diagonally extending short hole 97*e* (see FIG. 17) drilled in from chamber 71 of valve V1 providing communication between hole 97*d* and chamber 71 of valve V1. The ends of holes 97*a,* 97*b,* 97*c* and 97*d* at the faces of the block are plugged as indicated at 98 (four instances).

Referring particularly to FIGS. 11, 13, 16 and 17, a transfer passage indicated in its entirety by the reference numeral 99 interconnects the transfer port 83 of valve V9 with chamber 73 of valve V1. This passage 99 (which is similar to passage 97) is formed by holes drilled in block 57 as follows: hole 99*a* (see FIG. 16) drilled from the end 57*f* of the block to port 83 of valve V9; hole 99*b* drilled from the top of the block to hole 99*a* outward of and parallel to the bore 61 of valve V9; hole 99*c* drilled from face 57*a* of the block intersecting hole 99*b;* long hole 99*d* drilled form the end 57*e* of the block all the way to hole 99*c* (resembling hole 97*d*); diagonally extending short hole 99*e* drilled in from chamber 73 of valve V1 providing communication between hole 99*d* and chamber 73 of valve V1. The ends of holes 99*a,* 99*b,* 99*c* and 99*d* at the faces of the block are plugged as indicated at 100.

Figure 11A:
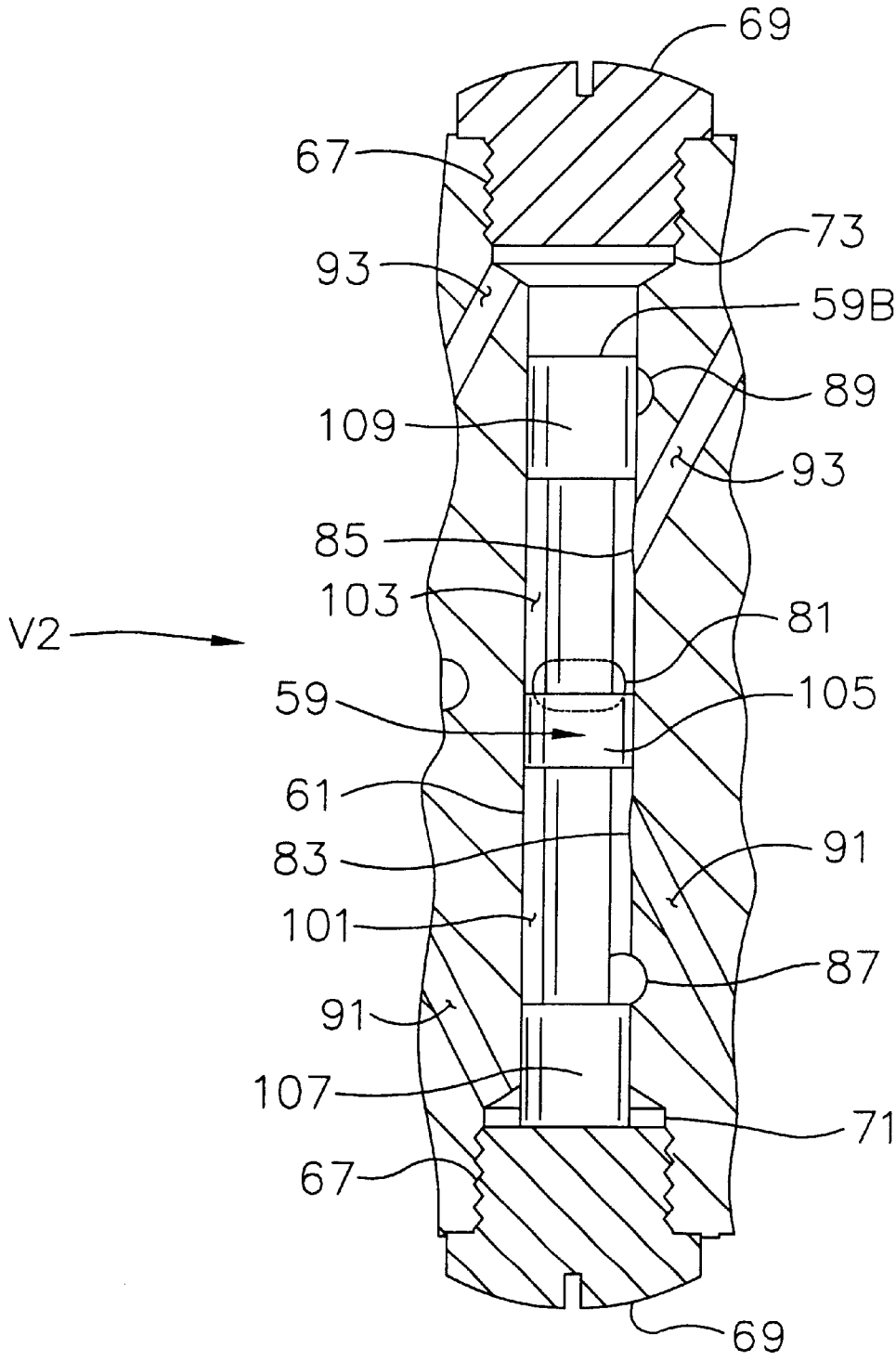
FIG. 11A is an enlarged fragment of FIG. 11 illustrating one of the nine divider valves thereof.

As to each of valves V1–V9, the valve spool 59 thereof has annular grooves 101 and 103 between a central land 105 and lower and upper lands 107 and 109 (see FIGS. 11, 11A and 12). In the stated first position of each spool (the lower position illustrated in FIGS. 11 and 11A), land 105 is below inlet port 81, groove 101 provides communication between ports 83 and 87, groove 103 provides communication between ports 81 and 85, and land 109 blocks port 89. The spool is movable up through an upstroke to the stated second (upper) position illustrated in FIG. 12 in which its upper end engages the upper end plug 69 and in which land 105 is generally above inlet port 81, land 107 blocks port 87, groove 101 provides communication between ports 81 and 83 and groove 103 provides communication between ports 85 and 89.

Assuming the flow divider FD is primed with lubricant, upon delivery of lubricant under pressure to passage 75, lubricant flows through the inlet port 81 of valve V9, passes via groove 103 in the spool V9 to port 85 of V9, thence via passage 97 to chamber 71 of valve V1, driving the spool of V1 up to the raised position. This forces a metered charge of lubricant out of the upper end of the V1 bore 61 and through passage 99 to the V9 port 83. The metered charge passes via groove 101 in the V9 spool (which is down) to the V9 port 87 and thence to outlet 01.

With the V1 spool in raised position, lubricant is delivered from the V1 inlet 81 via the V1 groove 101 to the V1 transfer port 83 and the V1 to V2 passage 91, passing via the V1 to V2 passage 91 to chamber 71 of valve V2. This drives the V2 spool up, forcing a metered charge of lubricant from V2 chamber 73 via the V2 to V1 passage 93, V1 groove 103 and V1 port 89 to outlet 02.

With the V2 spool in raised position, lubricant is delivered from the V2 inlet 81 via the V2 groove 101 to the V2 port 83 and the V2 to V3 passage 91, passing via the V2 to V3 passage 91 to chamber 71 of valve V3. This drives the V3 spool up, forcing a metered charge of lubricant from V3 chamber 73 via the V3 to V2 passage 93, V2 groove 103 and V2 port 89 to outlet 03.

The spools of valves V4 to V9 are then driven up in sequence for successive delivery of metered charges of lubricant from outlets 04–09 in similar manner. When the V9 spool moves up, lubricant is delivered from the V9 inlet port 81 via the V9 groove 101, the V9 port 83 and passage 99 to chamber 73 of valve V1, driving the V1 spool back down and forcing a metered charge of lubricant through passage 97 to V9 port 85 and outlet 010.

With the V1 spool down, lubricant is delivered via V1 port 81, V1 groove 103, V1 port 85, the V1–V2 transfer passage 93 to chamber 73 of valve V2, driving the V2 spool back down, thereby forcing a metered charge of lubricant via the V2 to V1 passage 91 to valve V1, the V1 groove 101, V1 port 83 and outlet 011.

The spools of valves V3–V8 are then driven back down in sequence for successive delivery of metered charges of lubricant from outlets 012–018 in similar manner. When the V8 spool goes down, lubricant is delivered from the V8 inlet 81 via V8 groove 103 and the V8 to V9 passage 93 to the V9 chamber 73, thereby returning the V9 spool to the down position. The eighteen-shot cycle involving the successive delivery of metered charges of lubricant from outlets 01–018 is repeated on repetition of delivery of lubricant under pressure to the flow divider FD.

Figure 10A:
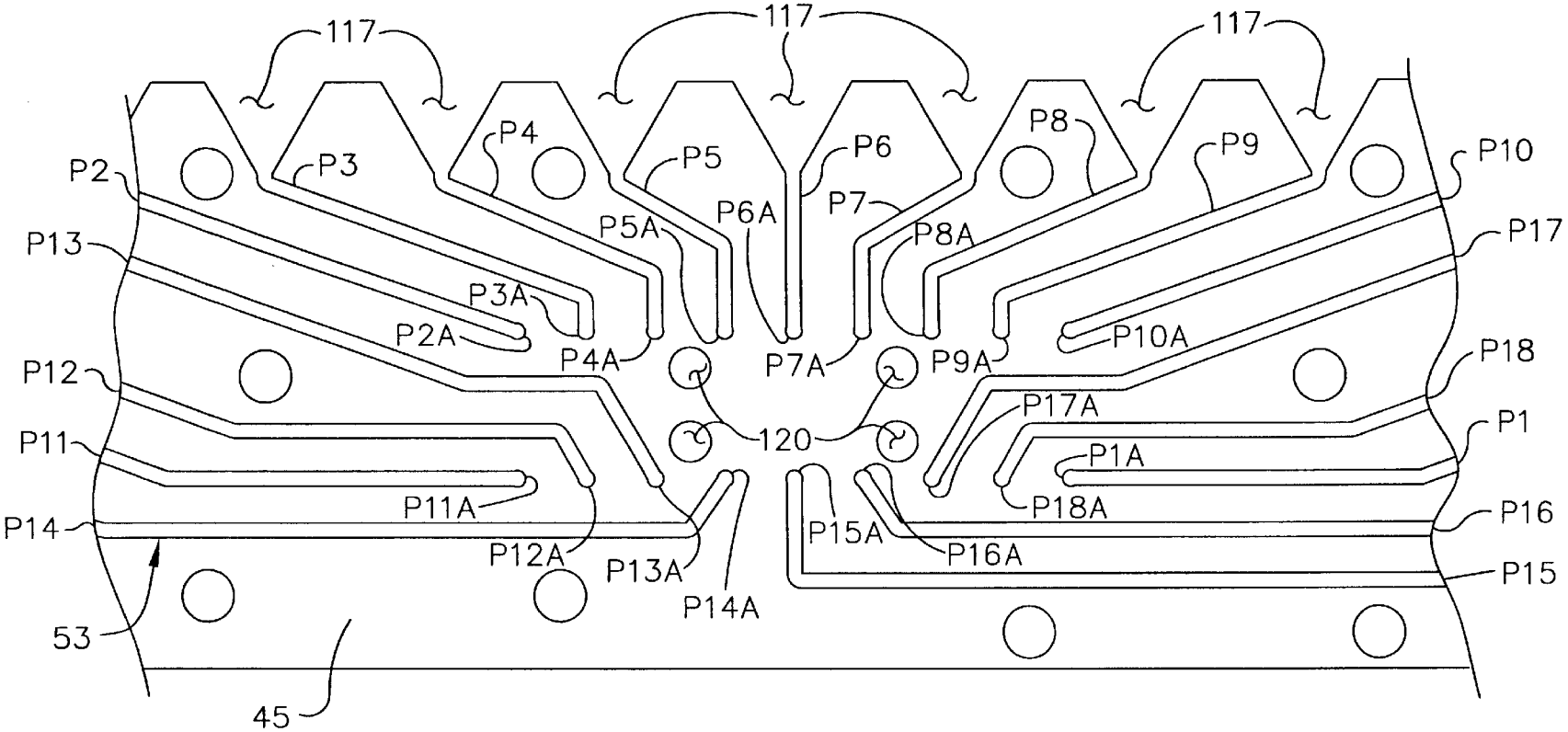
FIG. 10A is an enlarged fragment of FIG. 10.

As to each applicator A1, each of the two flow dividers FD is mounted on bar 35 with the inlet end (fitting 76 in FIGS. 6 and 7) directed forward (i.e. toward the curve 3), the outlets 02–010 lying in a top row and the outlets 011–018 and 01 lying in a bottom row as appears in FIG. 18. Each outlet is in communication via holes such as indicated at 115 in the mounting bar 35, spacer plate 47 and gaskets 51, 65 with the inlet end of a respective one of the lubricant passages of set 53 of passages in the respective distributor D1, D2. The passages P1–P18 in set 53 of passages in the distributor are identified by the letter P (e.g., in FIGS. 10 and 10A) and a numeral from 1 to 18 significant of the divider valve outlets 01–018 serving them (and the sequence of delivery of the metered charges of lubricant therethrough). Each passage P has an inlet end (eighteen in each of the two sets) designated P1*a*–P18*a,* respectively. These inlet ends are in register with (i.e., in the same pattern as) outlets 01–018 of the respective flow divider. Passage P6 leads straight up from end P6*a* centrally of the group. Passages P1 and P7–P18 fan out in one direction lengthwise of the distributor from ends P1*a* and P7*a*–P18*a;* passages P2–P5 and P11–P14 fan out in the opposite direction lengthwise of the distributor. Each passage extends to an outlet 117 at the top of the distributor of flaring conformation.

Each of the flow dividers FD is fastened on the mounting bar 35 with its outlets 01–018 in communication with the inlet ends P1*a*–P18*a* of the lubricant passages P1–P18 in the respective distributor D1, D2 by means comprising four screws each designated 119 (FIGS. 3 and 8) having heads engaging plate 49 and extending through appropriate screw holes 120 in plates 49, 45 and 47, gasket 51, plate 35 and gasket 65, threaded in tapped holes 121 in the FD block 57.

Each lubricant applicator or wiper bar A2 is generally identical to applicator A1 as above described except that, where in each applicator A1 the flow dividers FD are mounted with their inlet ends directed forward (i.e. toward the curve 3), in each applicator A2 the flow dividers FD are mounted with their inlet ends directed rearward (i.e. away from the curve 3). Thus, the FD outlets which are at the top and bottom in FIG. 18 are at the bottom and top in each applicator A2 and while the passages in A2 are the same as in A1, the delivery therethrough is in accordance with the inverse positioning of the FD outlets.

Figure 4:
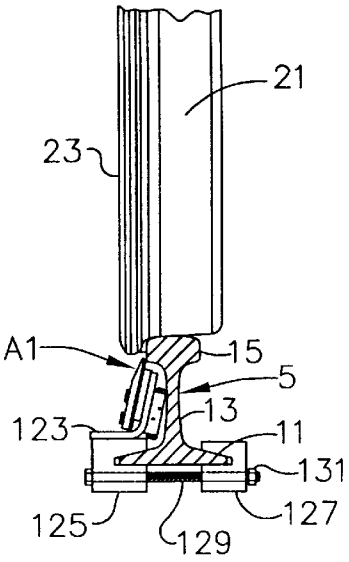
FIG. 4 is a view in vertical section on line 4—4 of FIG. 3.
Figure 2:
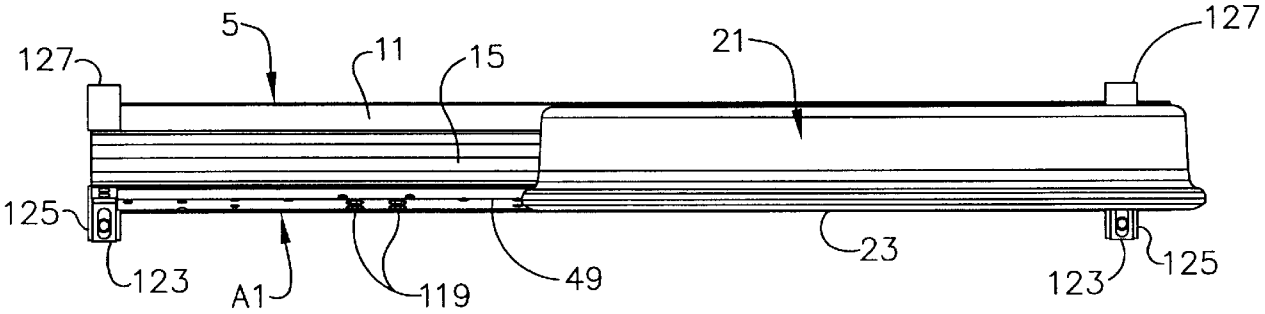
FIG. 2 is a view generally in plan of a length of a rail showing one of the applicators as applied to the rail and a wheel of a railroad vehicle riding over the rail.
Figure 3:
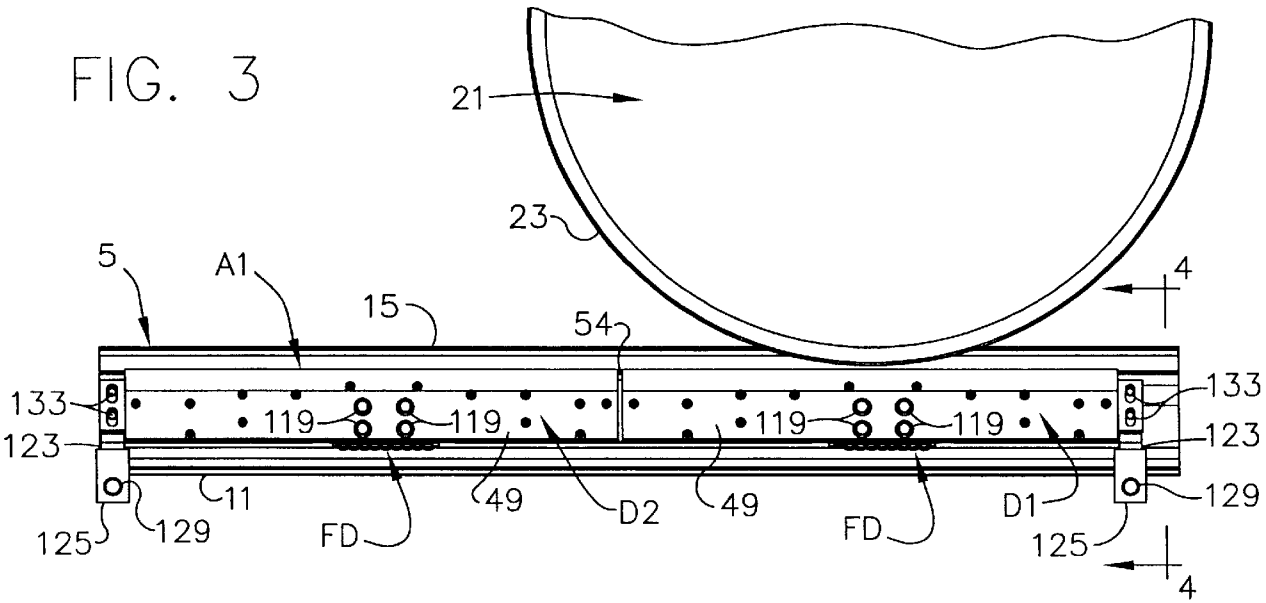
FIG. 3 is a view in elevation of the length of rail, the applicator and part of the wheel shown in FIG. 2.
Figure 5:
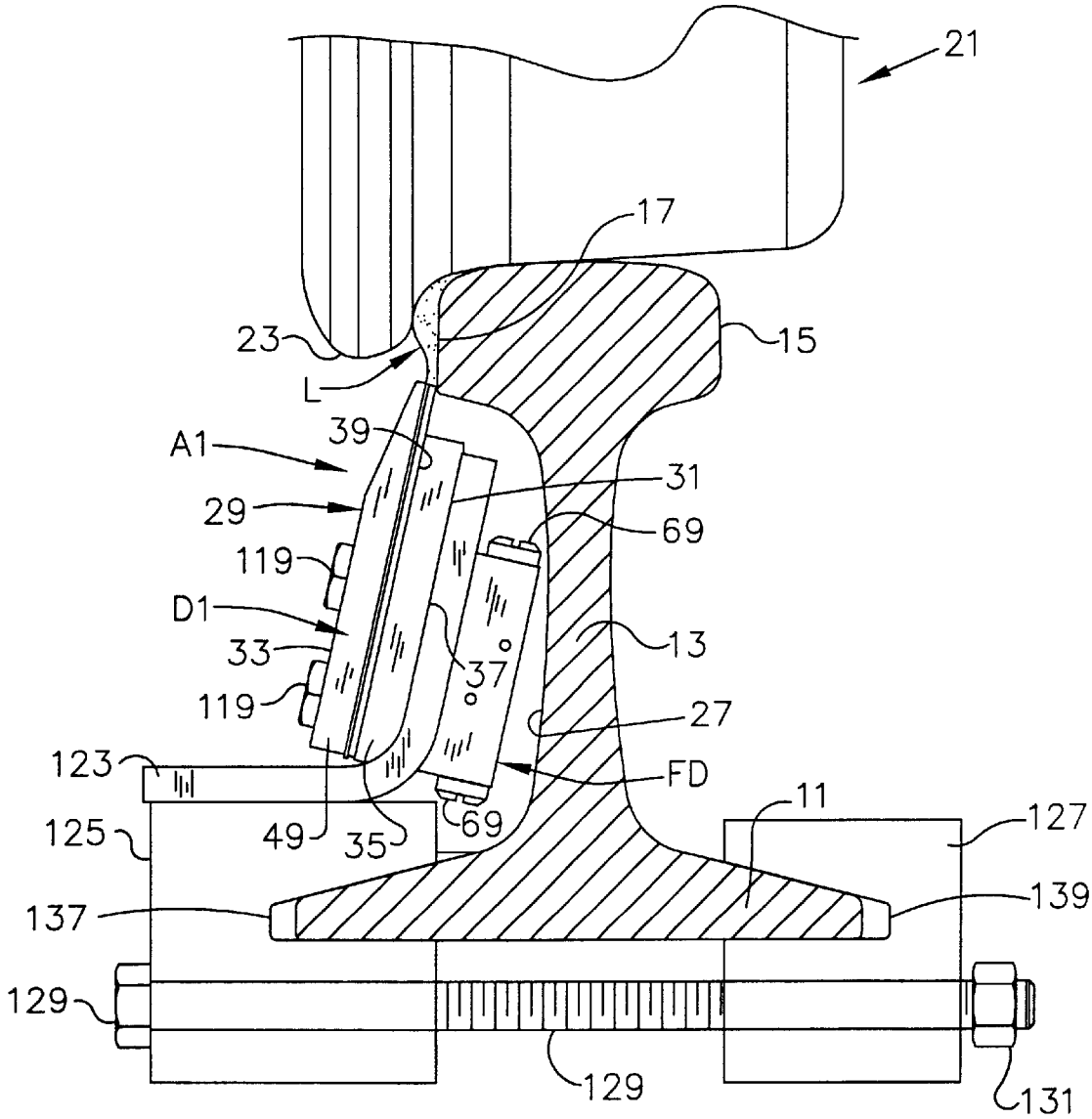
FIG. 5 is an enlarged fragment of FIG. 4.

Referring more particularly to FIGS. 4 and 5, showing how each applicator or wiper bar A1, A2 is mounted on the inside of the respective rail, the mounting means therefor comprises a J-shaped support 123 at each end 43 of the mounting bar 35 on a first rail flange clamp jaw constituted by a block 125 engaging the inner edge of the flange 11 of the rail in association with a second rail flange clamp jaw constituted by a block 127 engaging the outer edge of the flange of the rail, with a clamp bolt 129 extending under the flange having a nut 131 threaded thereon drawing the jaws together for tight securement of the applicator to the rail including lateral securement. The mounting bar 35 is adjustably secured to the support 123 by screws 133 extending through slots 135 in the ends 43 of the mounting bar. The blocks 125 and 127 have recesses 137, 139 receiving the respective edges of the flange.

Referring to FIG. 1, a system included in the overall lubrication system 19 for supplying lubricant (grease) under pressure to the four lubricant applicators or wiper bars A1, A2 of the system 19 in response to approach of a train to the curve 3 is indicated in its entirety by the reference numeral 141. This supply system 141 includes a unit 143 (see also FIG. 19) comprising a container 145, constituted by a steel drum for holding a supply of lubricant located at one end of a housing 147. The other end is open as indicated at 149 and has a door. The housing 147 is placed on the ground alongside stretch 1 of track in proximity to the four applicators. The housing, made of sheet steel and suitably painted, comprises a bottom 153 on skids 155, vertical side walls 157 and a top 159, being closed at said one end by the drum 145. As shown in FIG. 1, the drum has a lid 161 hinged, for example, at 163, which is thrown open for top filling with lubricant.

A pump 165 in the housing 147 functions in response to passage of a train approaching the curve 3 to pump lubricant under pressure out of the drum 145 for delivery to the four A1 flow dividers FD and the four A2 flow dividers FD of the four applicators. A pipe 167 extends out from near the bottom of the drum 145 into the housing 147 adjacent one side of the housing having a vertical flange 169 at its distal end in the housing. The pump 165 is a lance pump of the type disclosed in the allowed coassigned pending U.S. patent application Ser. No. 09/151,526, filed Sep. 11, 1998 entitled Pump, oriented horizontally instead of vertically with its head 171 mounted on the flange 169 and its lance structure extending through pipe 167 into the drum 145, and with an electric motor 173 for driving the pump tube designated 101 in said application instead of the hydraulic motor shown therein. A lubricant hose line 175 extends from the outlet of the pump to a tee 177 having its stem mounted in the adjacent side wall 157 and its head extending vertically on the outside of the side wall. A lubricant hose line 179 extends from the lower end of the head of the tee under the rail 5 adjacent the housing to the inlet of an eight-way distributor 181 (FIG. 1) referred to as the master distributor (to be described) serving eight hose lines each designated 183 fanning out from the master distributor between the rails to the inlets 75*a* of the four A1 flow dividers and the four A2 flow dividers. The master distributor serves to divide the input from line 179 into eight substantially equal deliveries via lines 183. A relief valve 185 (FIG. 19) is provided at the upper end of the head of the tee. The housing is provided with four apertured lugs 187 for attachment of lines for hoisting it onto a car for transport to a place of installation and hoisting it off the car onto the ground.

Figure 20:
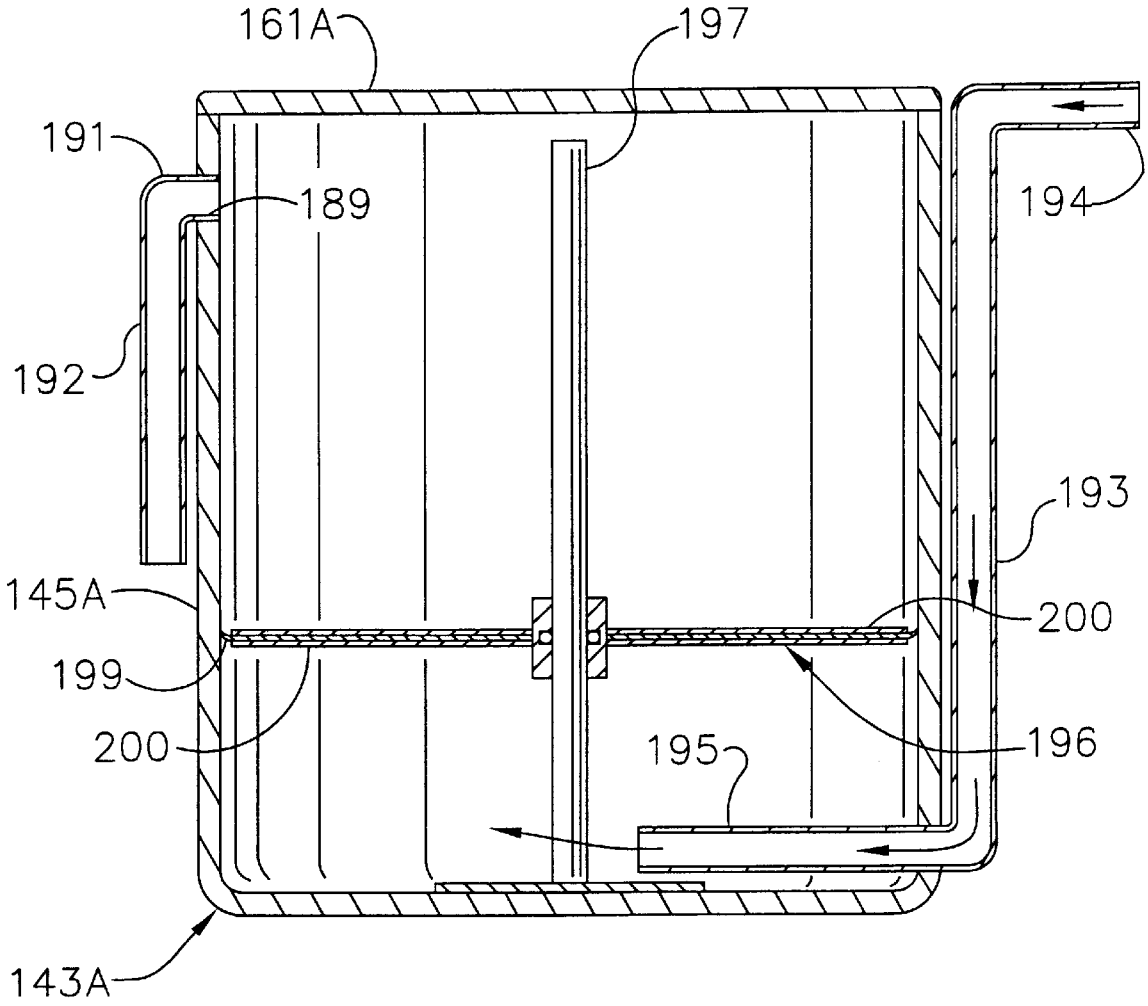
FIG. 20 is a view in vertical section showing a modification of the lubricant supply shown in FIG. 19.

Illustrated in FIG. 20 is another embodiment of the unit 143 designated 143*a* wherein the drum 145*a* is adapted for being filled by having lubricant pumped into its bottom from a supply on a railroad car, for example. The drum 145*a* has a fixed lid 161*a* having a vent hole at 189 with an elbow 191 and vent pipe 192 for venting air from the drum during bottom filling. The bottom filling is shown as being via a fill pipe 193 extending down on the outside of the drum at one side thereof and having an upper inlet 194 and an outlet end 195 extending radially inward through the wall of the drum adjacent the bottom of the drum to the center (to avoid grease piling up on one side of the drum). A weighted follower 196 slidable on a vertical guide rod 197 is provided in the drum of the unit 143*a* for pressing down on the lubricant in the drum to aid in maintaining the pump primed with high viscosity lubricant (grease) and to increase the usable volume of the drum. The follower 196 comprises a sealing member 199 disposed between a pair of metal plates 200, the sealing member extending radially outward beyond the outer edges of the plates for sealing (wiping) engagement with the side wall of the drum.

Figure 21:
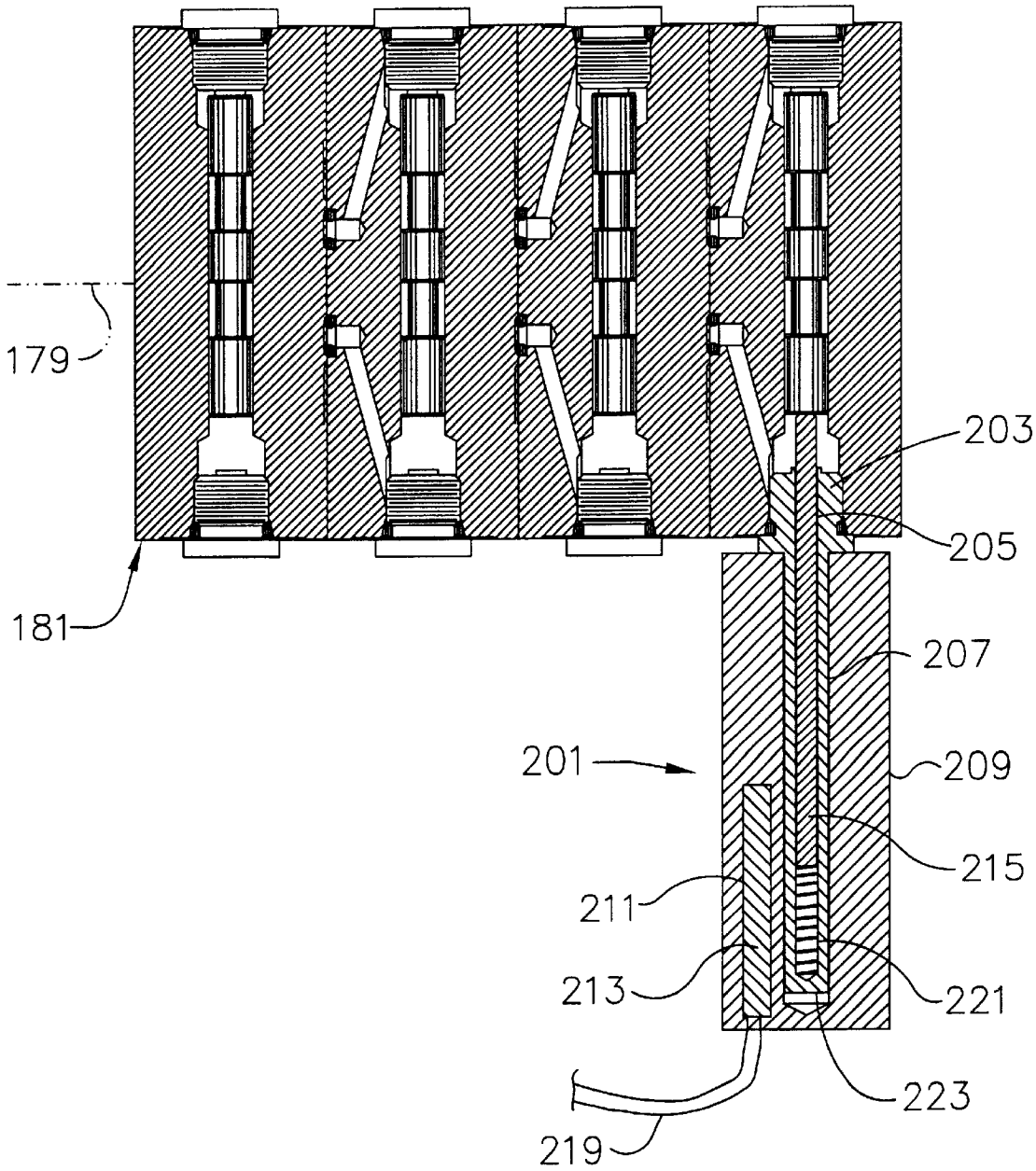
FIG. 21 is a view in section of a flow divider means constituting a master distributor serving the four applicators or wiper bars, turned around from its showing in FIGS. 1 and 1A.
Figure 22:
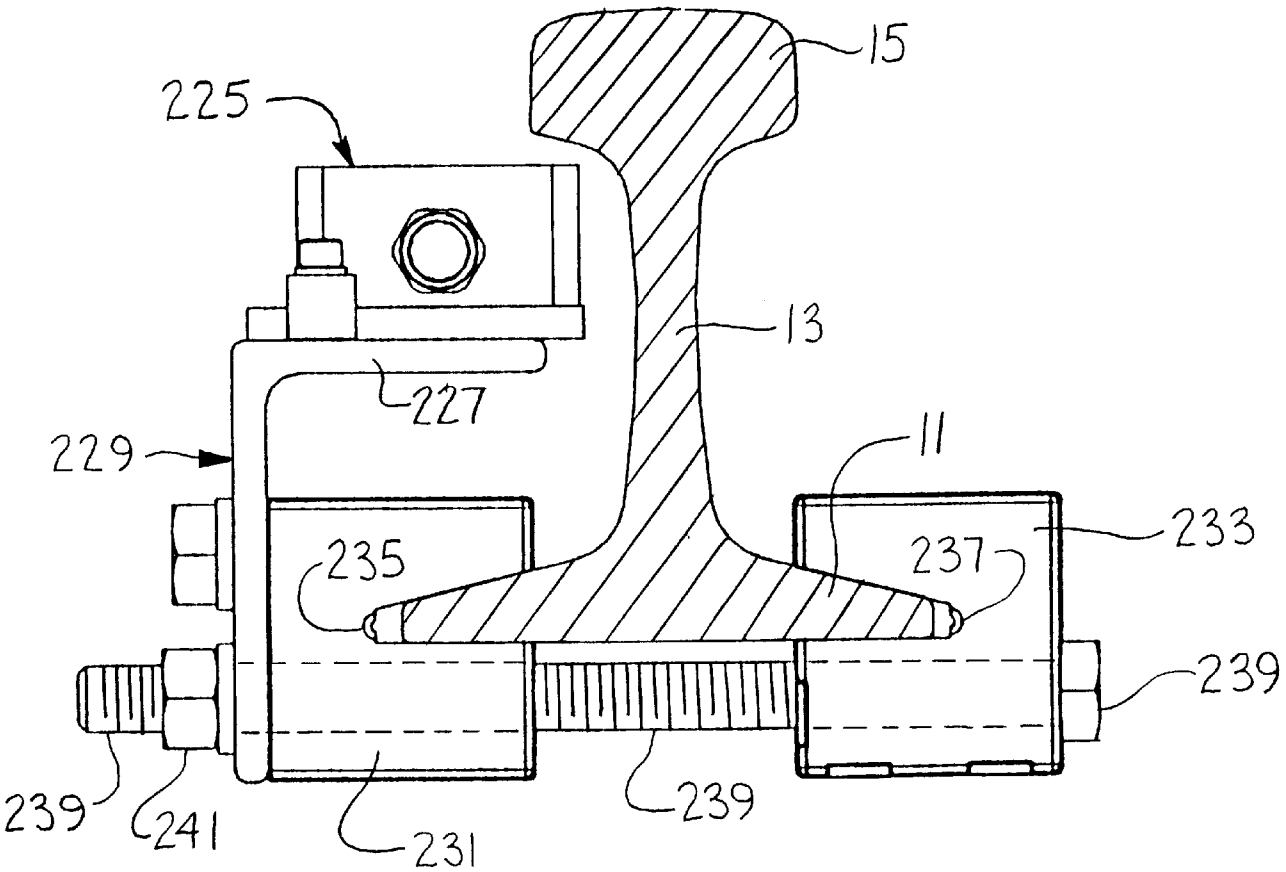
FIG. 22 is a view in enlarged vertical section generally on line 22—22 of FIG. 1 showing a sensor and its mount.
Figure 23:
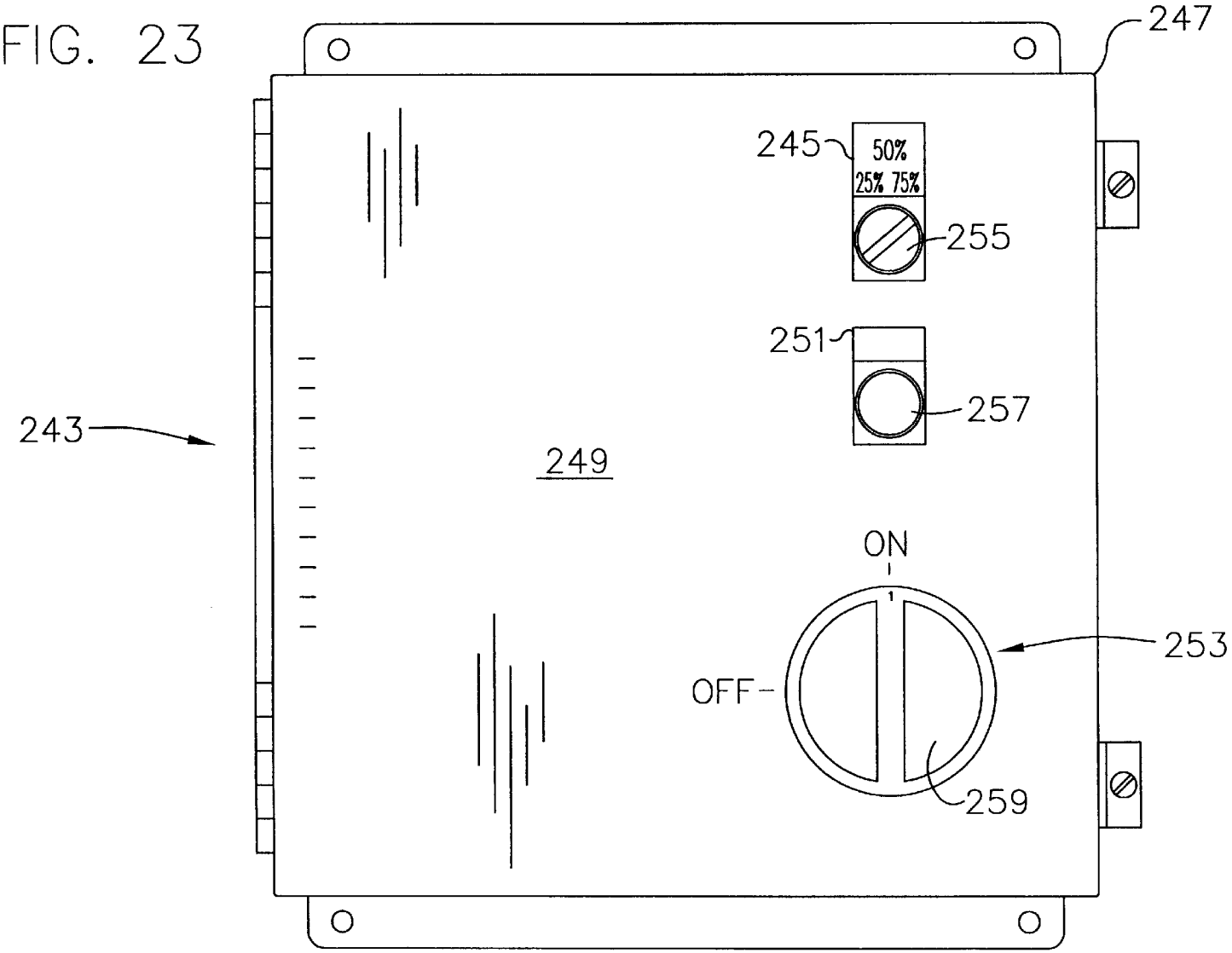
FIG. 23 is a view of the front of a controller shown in FIG. 19 on a larger scale than FIG. 19.
Figure 24:
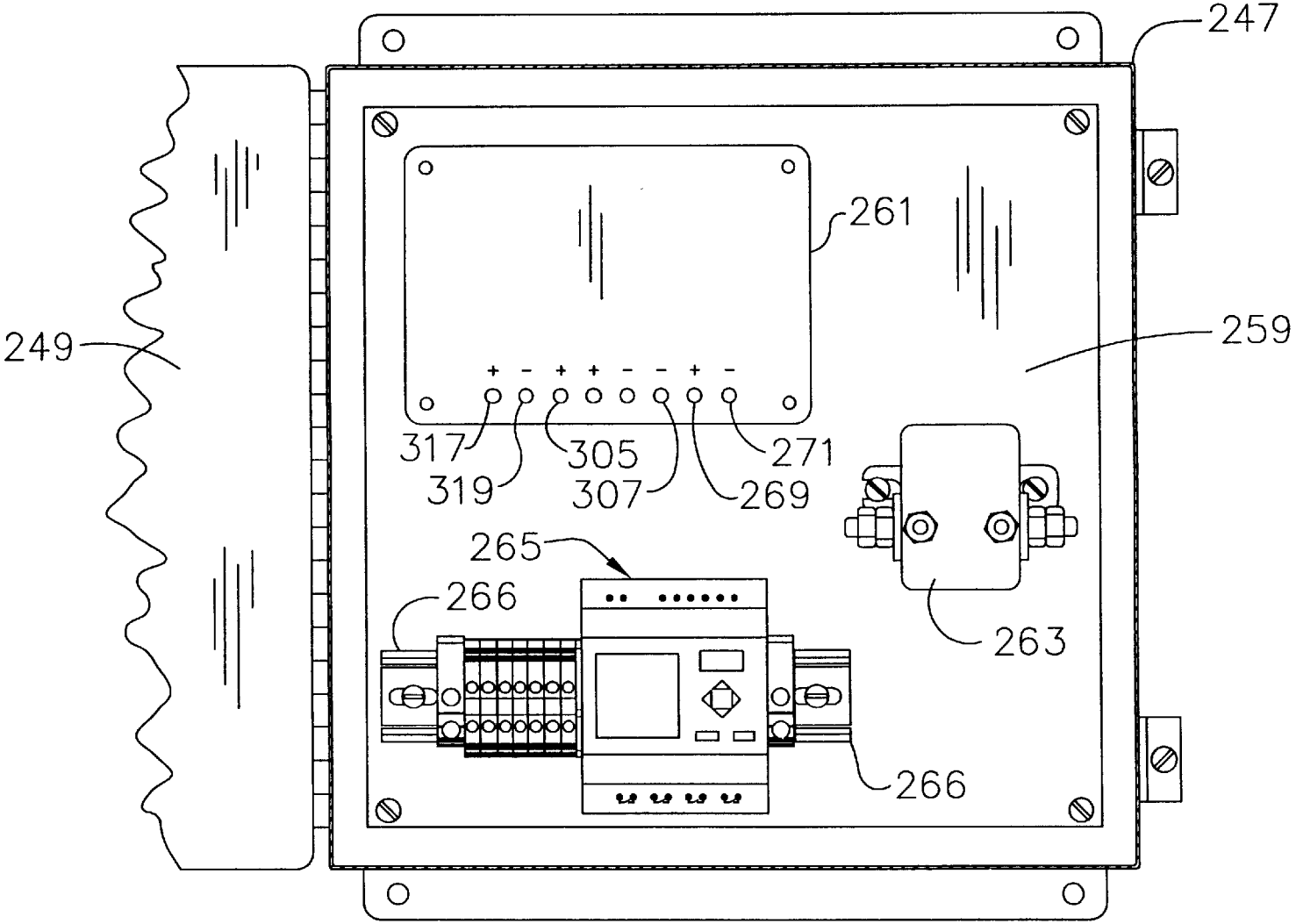
FIG. 24 is a view of the controller with a front door thereof open to show interior detail.

The master distributor 181 (see FIGS. 1, 1A and 21) preferably comprises a four-valve flow divider similar to the flow dividers FD, differing from the latter in having only four instead of nine divider valves, and in having a sensor device generally designated 201 operable in response to operation of the four-valve flow divider 181 through an eight-shot cycle thereof to transmit an electrical signal for the monitoring thereof as will be subsequently described. For this purpose, the sensor device comprises a special plug 203 for the No. 8 outlet end of the fourth valve having a central opening 205 and an elongate hollow extension 207 on which is mounted an elongate body 209 having a recess 211 in which is lodged a magnetic switch 213. A magnetic rod 215 extends from the spool of the fourth divider valve through the opening 205 in the plug 203, being slidable therein and in the hollow extension 207. The arrangement is such that when the spool of the fourth divider valve is driven through its stroke for delivery of lubricant through the No. 8 outlet, it drives rod 215 in outward direction and the rod activates magnetic switch 213 to generate and deliver a signal via line 219. A return spring 221 for the rod reacts from closed end 223 of the extension 207. Thus, master distributor 181 acts on each cycle thereof in effect to split the supply of lubricant thereto into eight deliveries via the eight delivery lines 183, and to transmit a signal that it has cycled. Other types of switches may be used to generate this signal.

System 141 includes a sensor 225 (see FIGS. 1, 1A, 22 and 25) for sensing passage of a train over the straight stretch 1 of track and signaling the unit 143 to effect operation of the pump motor 173 (in a manner to be described) to drive the lubricant pump 165 and thereby pump lubricant under pressure from the drum 145 through line 175, tee 177 and line 179 to the distributor 181, and via the eight lines 183 leading from the distributor 181 to the flow dividers D1 and D2 of the applicators or wiper bars A1, A2 on the rails 5 (two applicators and four flow dividers on each of the two rails). Sensor 225 is, for example, an electrically inductive proximity sensor such as the Model No. 1Q80-60NPP-KKO inductive proximity sensor sold by Sick Opic-Electronic Inc. of Bloomington, Minn. It is mounted on the inside of one of rails 5 a short distance ahead of the wiper bars on that particular rail on the upper horizontal leg 227 of a support 229 of inverted L-shape on a first rail flange clamp jaw constituted by a block 231 engaging the inner edge of the flange 11 of the rail in association with a second rail flange clamp jaw constituted by a block 233 engaging the outer edge of the flange 11 of the rail. The blocks have recesses 235, 237 receiving the edges of the flange and are drawn together for tight securement of the sensor to the rail by a clamp bolt 239 extending under the flange having a nut 241 threaded thereon. The sensor 225 is positioned with the top thereof just below the head 15 of the rail so as to be just below the flange 23 of a wheel 21 passing thereover so that there is no contact thereof by the wheel.

The sensor 225 receives electrical power from a controller designated in its entirety by the reference numeral 243 (see FIGS. 1, 19, 23 and 24) and acts on sensing a passing train to send a signal to the controller 243 to effect energization of the pump motor 173 and operation of the pump 165 in one of three duty cycles as selected by a pump duty switch 245 of the controller 243. The latter comprises a metal enclosure or box 247 having a hinged front door 249 housed in the housing 147 for access via the doorway 149 of the housing on opening the housing door. The duty switch 245, a manual lubrication switch 251 for manual operation of system 141 and a disconnect or on-off switch 253 are mounted on the box door 249. The duty switch has a knob 255 at the front of the door rotatable to three different pump duty positions labelled 25%, 50% and 75%, for setting the controller for cycling of the pump at one of the following rates:

| | |
|---|---|
| 25% | 5 seconds on and 15 seconds off. |
| 50% | 10 seconds on and 10 seconds off. |
| 75% | 15 seconds on and 5 seconds off. |

The manual lubrication switch 251 is a push button switch, the button thereof being indicated at 257, and the disconnect switch 253 has a knob 259 rotatable between an ON position and an OFF position. Mounted inside the box 247 on the back 259 thereof (FIG. 24) are a power input unit 261 having a plurality of terminals, a relay 263 for motor 173 and a programmable logic controller unit 265 (PLC) set by switch 245 for the pump duty cycling set forth above. The mounting for the PLC 265 is indicated at 266.

Figure 25:
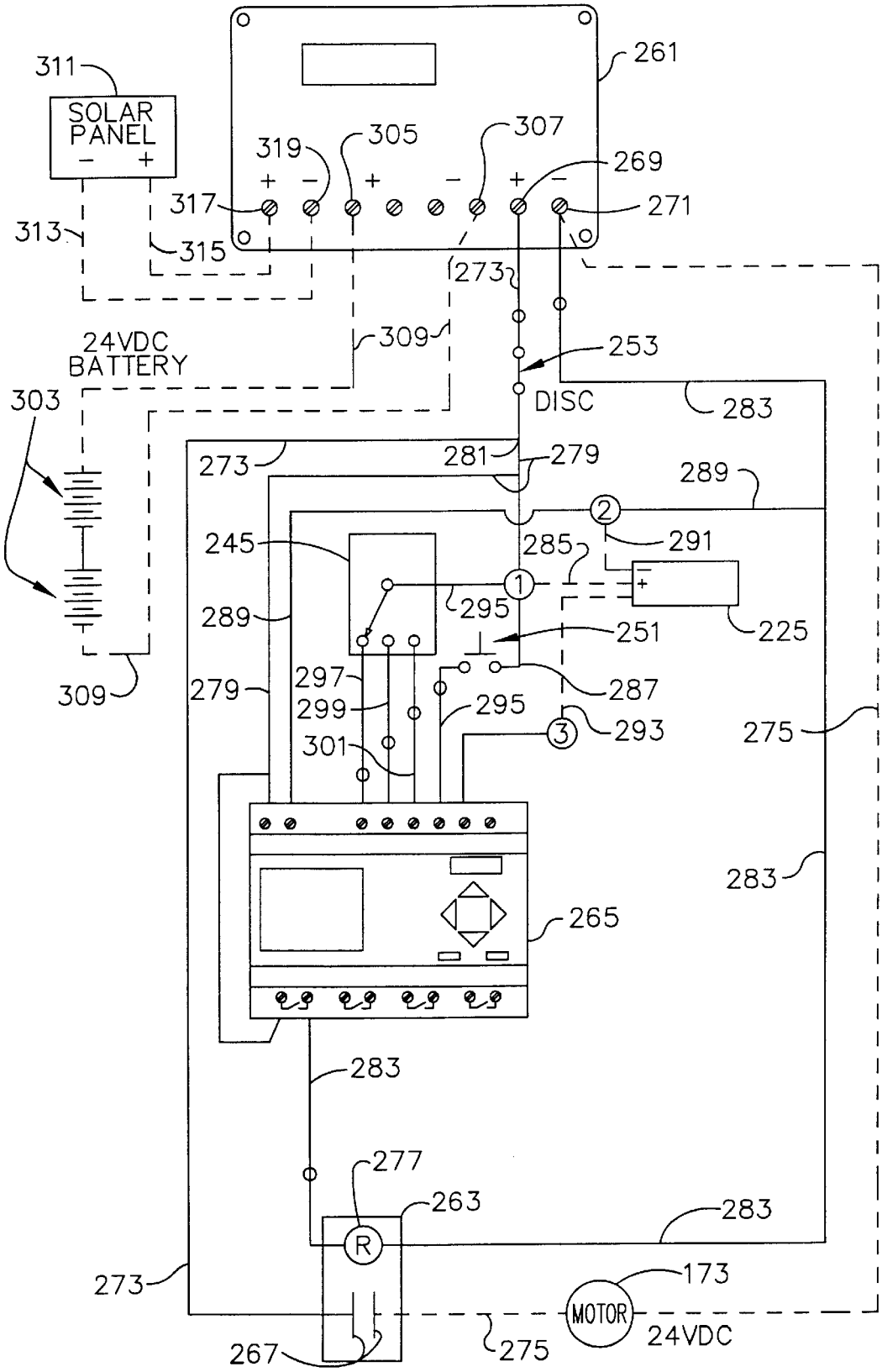
FIG. 25 is a wiring diagram showing the electrical system of the FIG. 1 apparatus including the controller of FIGS. 23 and 24.

Referring to FIG. 25 wherein electrical lines within the box 247 are diagrammed as solid lines and electrical lines outside the box (the field lines) as dotted lines, the pump motor 173 is shown as connected in series with the normally open terminals 267 of the relay 263 and the disconnect switch 253 between the plus and minus DC output terminals 269 and 271 of the unit 261 via a line 273 from the plus terminal 269 including the disconnect switch 253 leading to one of terminals 267 of the relay and a line 275 (dotted to show that it's a line installed in the field) extending from the other terminal 267 of the relay to the minus terminal 271, the motor 173 being energized whenever the relay circuit is closed by energization of the actuator of the relay indicated at 277.

The PLC 265 is operable in response to transmission of a signal from the sensor 225 to effect energization of the actuator of the relay for closure of the relay at 267 and resultant operation of the motor 173 (switch 253 being normally closed) in accordance with the pump duty cycle setting of switch 245, the actuator of the relay being connected in a circuit with the PLC 265 comprising a line 279 having a junction at 281 with line 273 just past switch 253 extending to the PLC 265, and a line 283 including the actuator of the relay extending from the PLC 265 to the minus terminal 271. With switch 253 closed, the sensor 225 is powered via a field line 285 from a line 287 including the manual lube switch 251 connected between line 279 and the PLC 265 and a line 289 extending from the PLC 265 to line 283 and a field line 291. Transmission of a signal from the sensor 225 to the PLC 265 is via a part field and part in-box line 293. At 295 is indicated an in-box line interconnecting line 287 and the movable contactor of the pump duty cycle switch 245, and at 297, 299 and 301 are indicated in-box lines interconnecting the 25%, 50% and 75% fixed contacts of switch 245 with the PLC 265.

Figure 19:
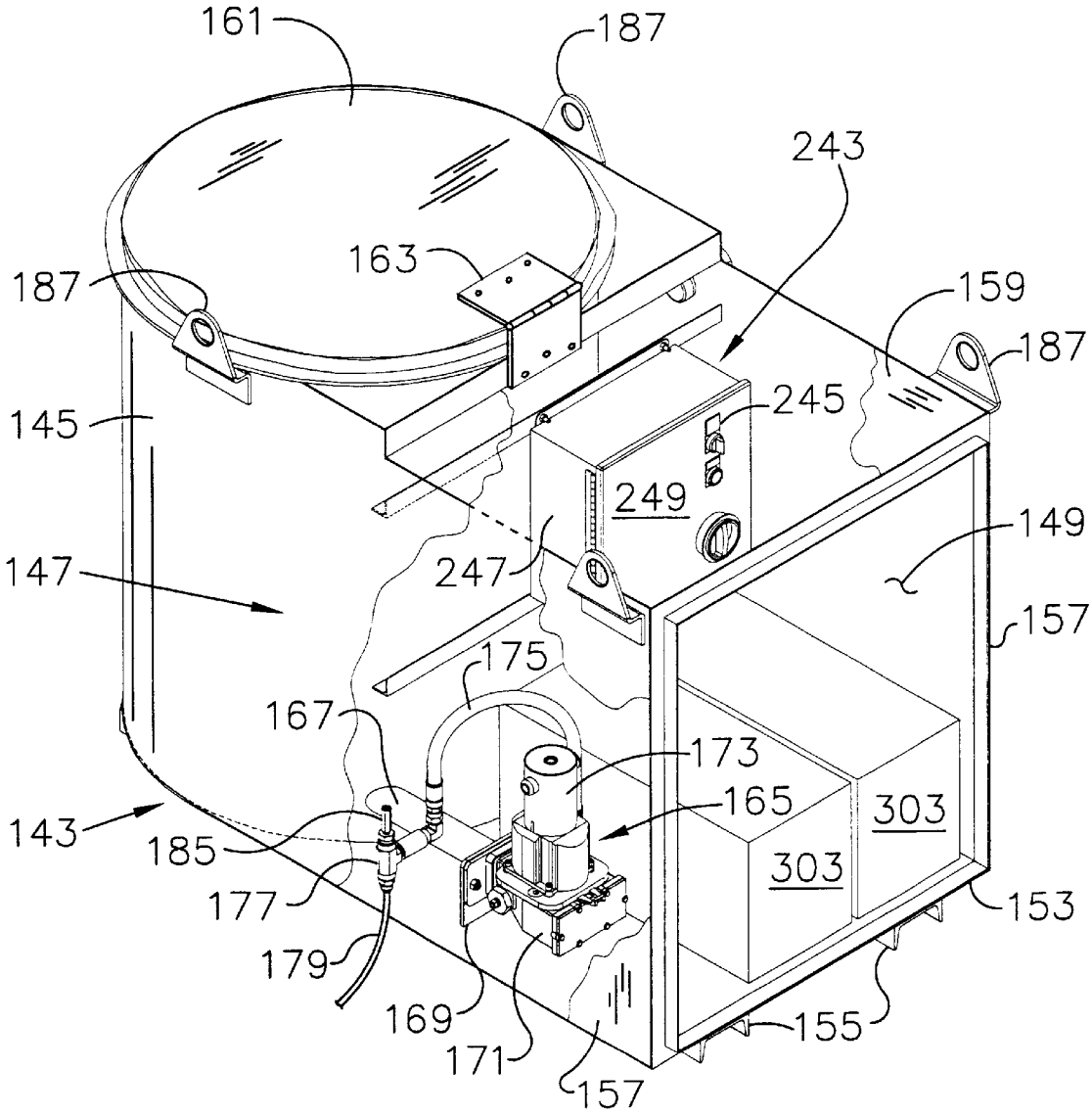
FIG. 19 is an enlarged view of the lubricant supply shown in perspective in FIG. 1, both of these views omitting a door and being partly broken away to show interior detail.

Batteries for supplying DC power to the power input unit 261 are indicated at 303 in FIGS. 1, 19 and 25, being shown in FIGS. 1 and 19 as housed in the housing 147. The batteries supply 24 volt DC, for example, to plus and minus input terminals 305 and 307 of the power input unit 261 via a field circuit indicated at 309. The batteries are maintained charged by interconnection therewith of a solar panel 311 via field lines 313 and 315 with plus and minus terminals 317 and 319 of the power input unit 261, the solar panel being pole-mounted as indicated at 320 in FIG. 1.

The electric motor 173, used instead of the hydraulic motor of the lance pump shown in the aforementioned U.S. patent application Ser. No. 09/151,526 in the instant solar-charged-battery-powered system, is a commercially available motor, preferably a 0.125 horsepower (at 1750 rpm) 24 volt DC motor sold by RAE Corporation of McHenry, Ill., with a suitable gear reducer connecting the output of the motor to the input shaft of the pump. The gear reducer has, for example, a 17.5 to 1 ratio for a speed of 100 rpm for the input shaft.

The power input unit 261 is a commercially available item which controls the charging of the batteries 303 by the solar panel 311 and serves in the monitoring of the state-of-charge of the batteries as will be subsequently described. The unit 261 is preferably a photovoltaic controller such as a Pro Star-30 photovoltaic controller sold by Morningstar Corporation of Olney, Md. The relay 263 is a commercially available single-pole single-throw normally open relay, more particularly a solid state relay, preferably a Model S1R1A10A6 solid state relay sold by SSAC Inc. of Baldwinville, N.Y. The PLC 265 is a commercially available logic module, preferably a LOGO 24 RC logic module sold by Siemens AG of Nuremberg, Germany. The solar panel 311 is a commercially available item, preferably a Siemens Solar SR 50 photovoltaic module sold by Siemens Solar Industries of Camarillo Calif.

When a train travels over the sensor 225 heading in the direction of the curve 3, every time a train wheel passes over the sensor it induces the sensor (without contact therewith) to transmit an electrical signal (a pulse) via line 293 to the PLC 265, power for the signal emanating from lines 285 and 291. On receiving the signal, the PLC 265 acts to establish the 279, 283 circuit through the relay 263, thereby establishing the motor circuit 273, 275 for operation of the motor 173 and pump 165 in accordance with the pump duty cycle determined by the setting of the pump duty switch 245.

The PLC 265 maintains the motor and pump in operation at least for a predetermined time interval (e.g., five seconds) related to the time elapsing between successive passage of one train wheel after another over the sensor 225, responding to successive receipt of signals within this interval to sustain the cycling of the pump in accordance with the pump duty cycle setting. Upon elapse of e.g. five seconds without a signal, due for example to the last wheel of a train passing by the sensor (or the train stopping), the PLC 265 breaks the relay circuit to stop the motor 173 and the pump 165.

On operation of the pump 165, lubricant is delivered under pressure via line 175, tee 177, and line 179 to distributor 181 which splits the delivery into eight individual deliveries via the eight lines 183 to the eight flow dividers FD embodied in the eight distributors D1 and D2 in the two applicators or wiper bars A1 and A2 on the one rail 5 and the two applicators or wiper bars A1 and A2 on the other rail in the straight stretch 1 of the track. Upon the delivery thereto of lubricant under pressure to each flow divider FD, metered charges of lubricant are delivered through the outlets 117 of the eighteen passages P1–P18 of each distributor D1, D2 for application to the inside faces 17 of the heads 15 of the rails at intervals as above described. Because the charge of lubricant delivered through each outlet 117 is a metered charge corresponding to the quantity of lubricant dispensed by a respective divider valve as it moves through a stroke, lubricant is distributed substantially uniformly to the rail at points corresponding to the outlets 117. This is believed to represent a substantial improvement over prior lubrication systems which distribute lubricant non-uniformly along the rails.

Figure 26:
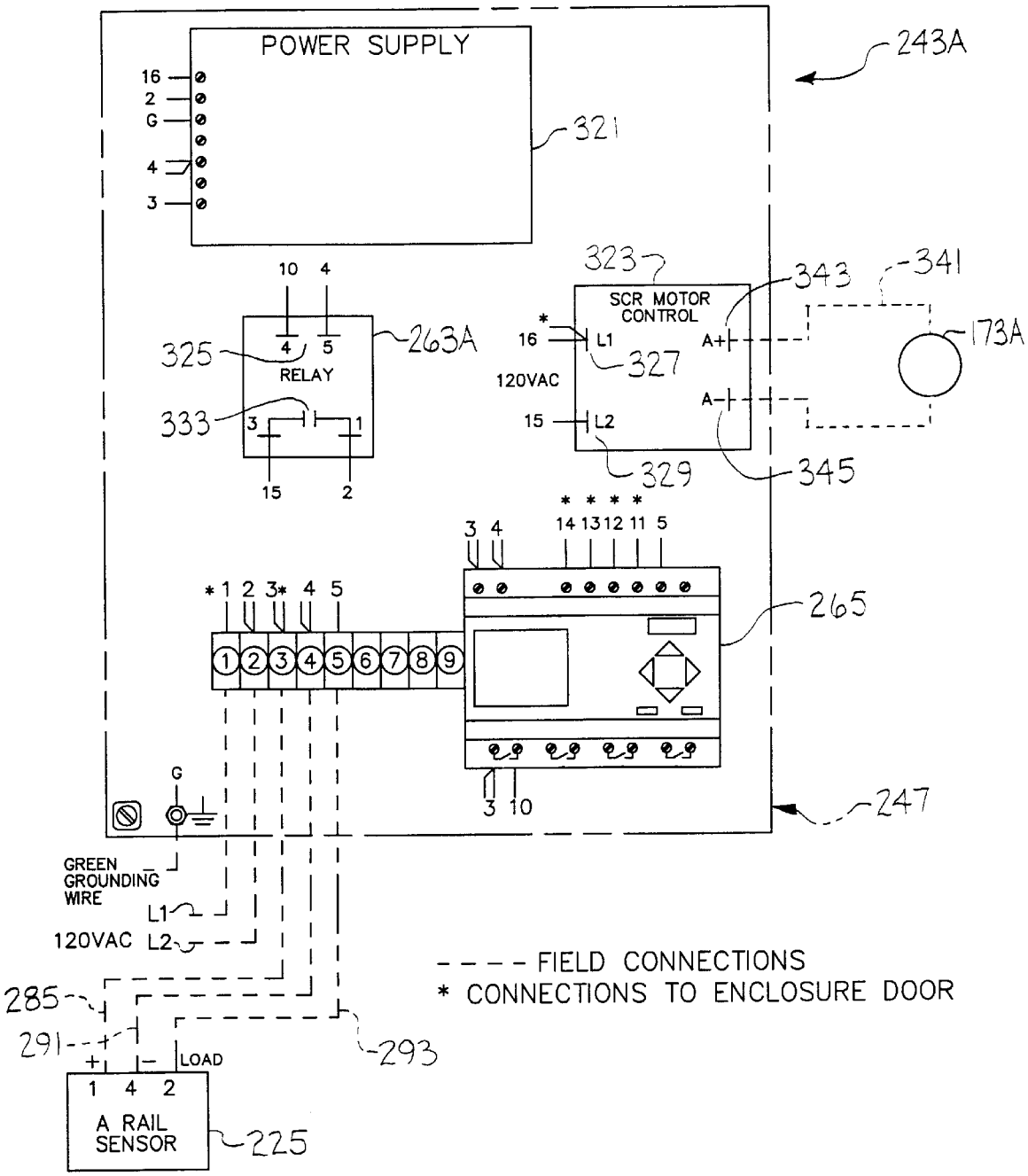
FIG. 26 is a view similar to FIG. 24 showing a modification of the controller.
Figure 27:
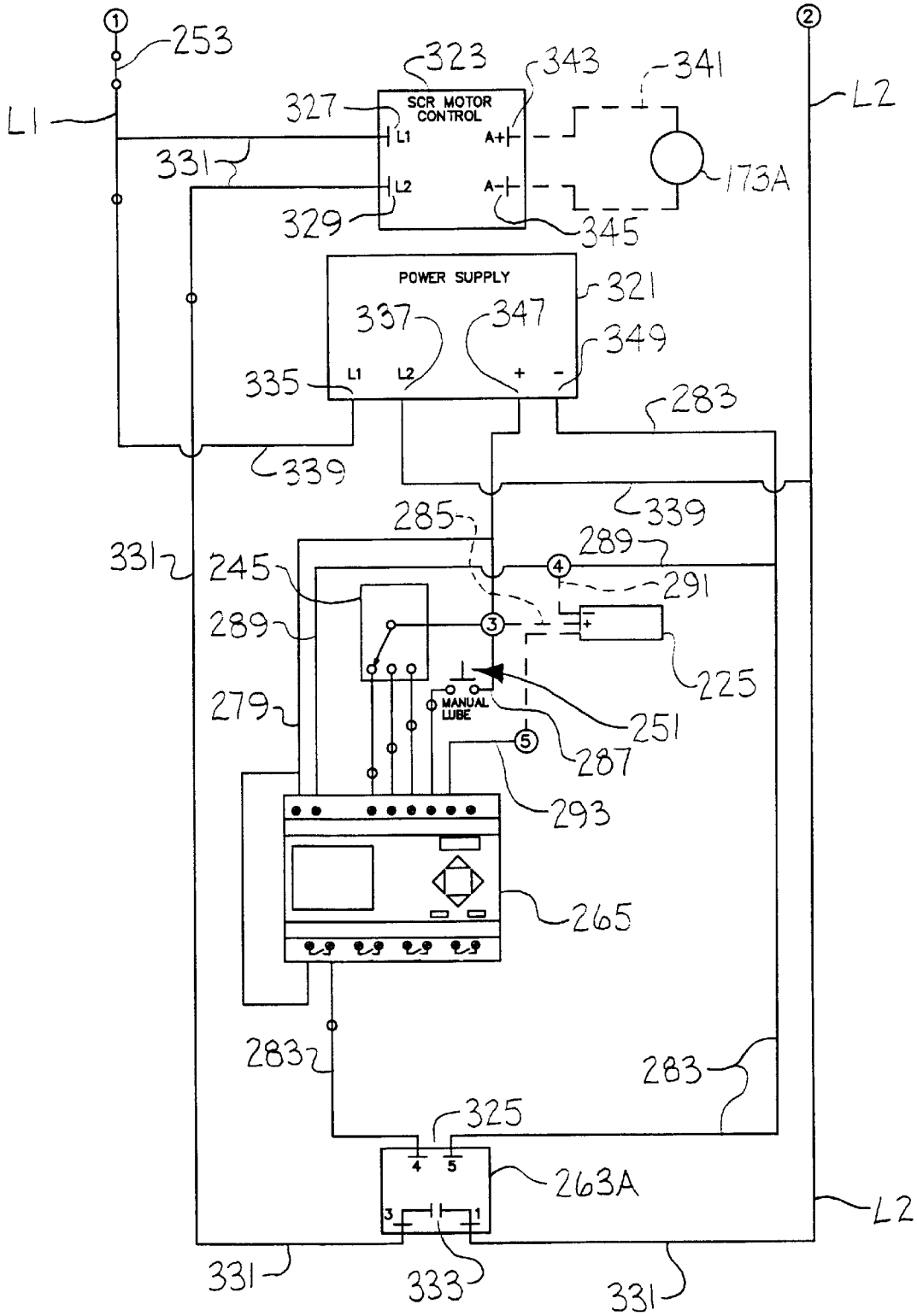
FIG. 27 is a wiring diagram similar to FIG. 25 showing the modification of the electrical system which includes the FIG. 26 controller.

Referring particularly to FIGS. 26 and 27, there is shown a modification of the above-described solar-charged-battery-powered system which may be used where there is an electrical power source (e.g., 120 VAC lines) available in the vicinity of the installation. For use in this modification the electric motor which drives the pump 165 is a 90 VDC motor the same as the aforementioned motor 173 except for being a 90 VDC instead of a 24 VDC motor, identified as motor 173*a* to distinguish it from motor 173. The controller 243 is modified by replacement in the box 247 of the photovoltaic controller 261 with an inverter 321 and addition of a DC motor drive 323 for motor 173*a* connected between 120 VAC power lines L1 and L2 as will be subsequently described. The modified controller is designated 243*a*. The motor drive 323 is a commercially available item, preferably an SCR P/N SC 43 motor control sold by RAE Corporation, of McHenry, Ill. It functions to convert 120 VAC to 90 VDC for supplying the motor 173*a*. The inverter 321 is a commercially available item, preferably a Model S-100F-24 power supply unit sold by Astrodyne Corporation of Taunton, Mass. It functions to convert the 120 VAC to 24 VDC for the PLC 265 and input 325 of a relay 263*a*. This relay 263*a* controls the motor drive, being a commercially available item, preferably a Model P/N SIR 2A6A4 solid state relay sold by SSAC Inc. of Baldwinville, N.Y., used instead of but essentially serving the same purpose as the relay 263 (i.e. to provide for energization and deenergization of the motor). The 120 VAC input terminals 327 and 329 of the motor drive 323 are connected in a line 331 under control of the disconnect switch 253 in series with the output 333 of the relay 263*a* across lines L1 and L2.

The 120 VAC terminals 335 and 337 of the inverter 321 are connected in a line 339 (also under control of the disconnect switch 253) across lines L1 and L2. The motor 173*a* is connected in a line 341 served by the 90 VDC terminals 343 and 345 of the motor drive 323. The 24 VDC terminals 347 and 349 of the inverter 321 service essentially the same 24 VDC circuitry (including rail sensor 225, manual lubrication switch 251, selector switch 245, PLC 265 and the relay input as in FIG. 25. That circuitry is repeated in FIG. 27 except for the disconnect switch 253 being in L1 and line 283 serving the input 325 of relay 263*a*.

The FIG. 27 120 VAC powered system operates essentially like the FIG. 25 solar-charged-battery-powered system as above described, acting on transmission of a signal by sensor 225 on passage of a train to the PLC 265 to establish the 283 circuit through relay 263*a* and thereby closing circuit 331 and acting via motor drive 323 to drive motor 173*a*. The 24 VDC circuit is continuously served by the inverter 321 (disconnect switch 253 normally being closed).

Figure 1A:
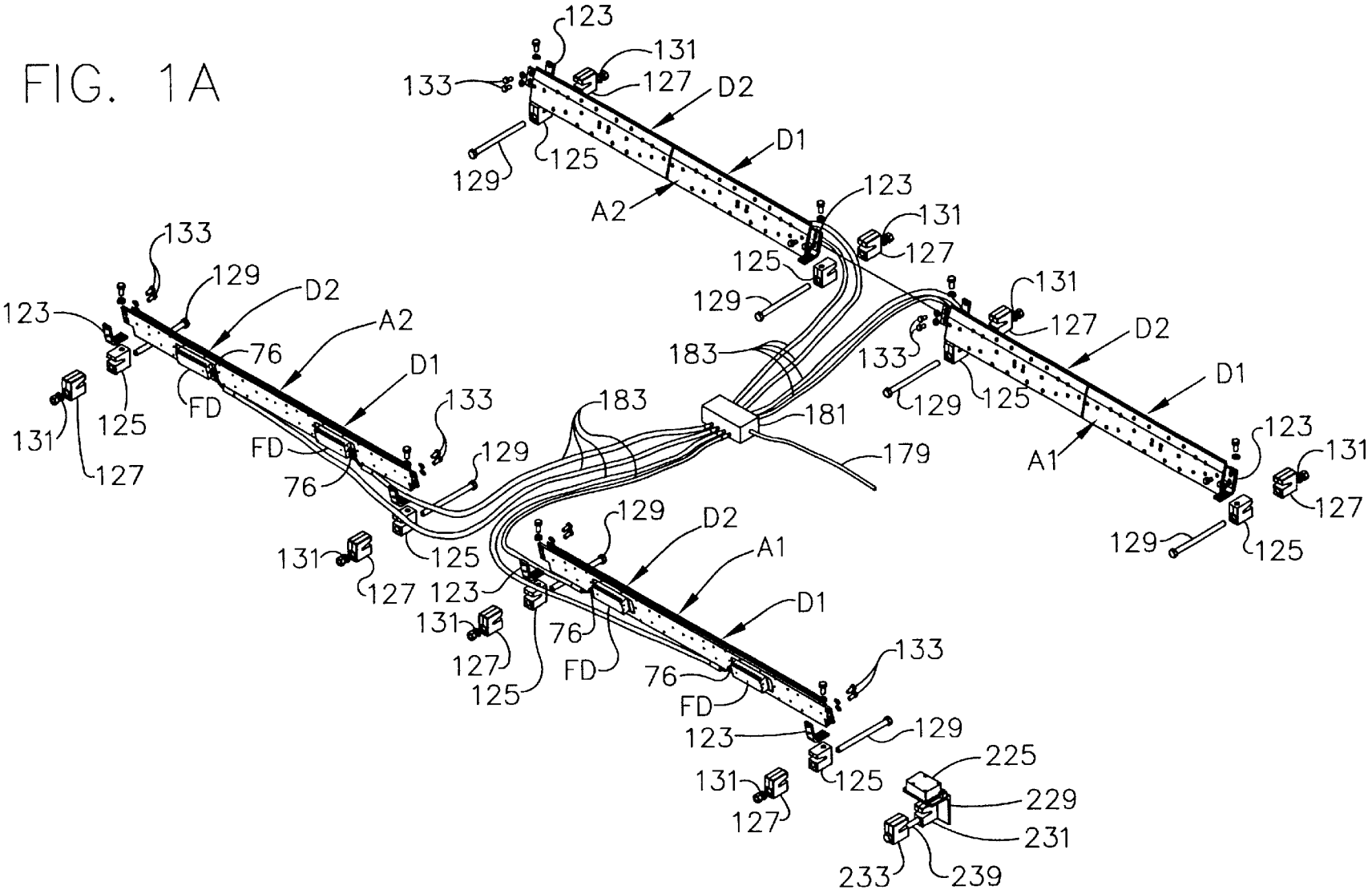
FIG. 1A is a semi-diagrammatic perspective illustrating the applicator arrangement shown in FIG. 1 omitting the tracks.
Figure 28:
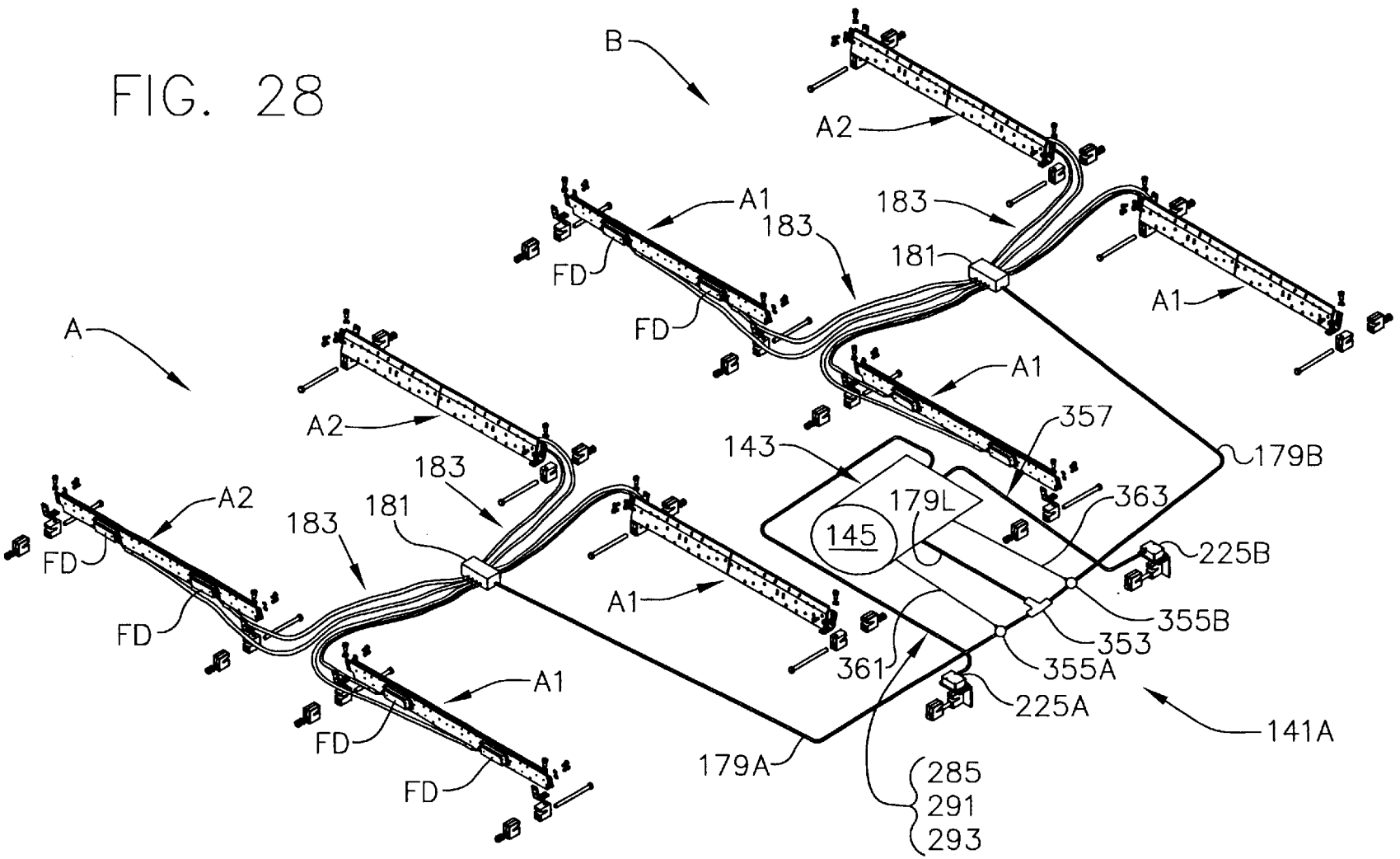
FIG. 28 is a view generally in perspective and omitting the tracks showing a dual track version of the lubrication system of the invention.

FIG. 28 shows a dual-track version of the apparatus of this invention, illustrating it in a manner similar to the illustration of the single-track version in FIG. 1A with the rails left out. One track is identified as the A track, the other as the B track. Each of the two tracks is provided with two applicators A1 and A2 on one rail and two applicators A1 and A2 on the other rail, in the same manner as shown in FIGS. 1 and 1A. A dual system for supplying lubricant under pressure to the applicators is indicated in its entirety at 141*a*, being similar to and augmented with respect to system 141 (as will be subsequently described) to handle passage of a train on track A or track B or simultaneous passage of trains on both tracks.

The system 141*a* comprises a container/housing unit which may be essentially the same as unit 143 above described, including pump 165 driven by motor 173 for pumping lubricant from drum 145, the output of the pump being delivered as shown diagrammatically via a lubricant line 179L (corresponding to line 179) to a tee 353 for supplying a lubricant line 179A extending to master distributor 181 for track A and a lubricant line 179B extending to master distributor 181 for track B. Line 179A includes a normally open solenoid valve 355A; line 179B includes a normally open solenoid valve 355B. At 225A is indicated the sensor for track A; at 225B is indicated the sensor for track B. Each of these two sensors is the same and mounted in place in the same manner as sensor 225.

Figure 29:
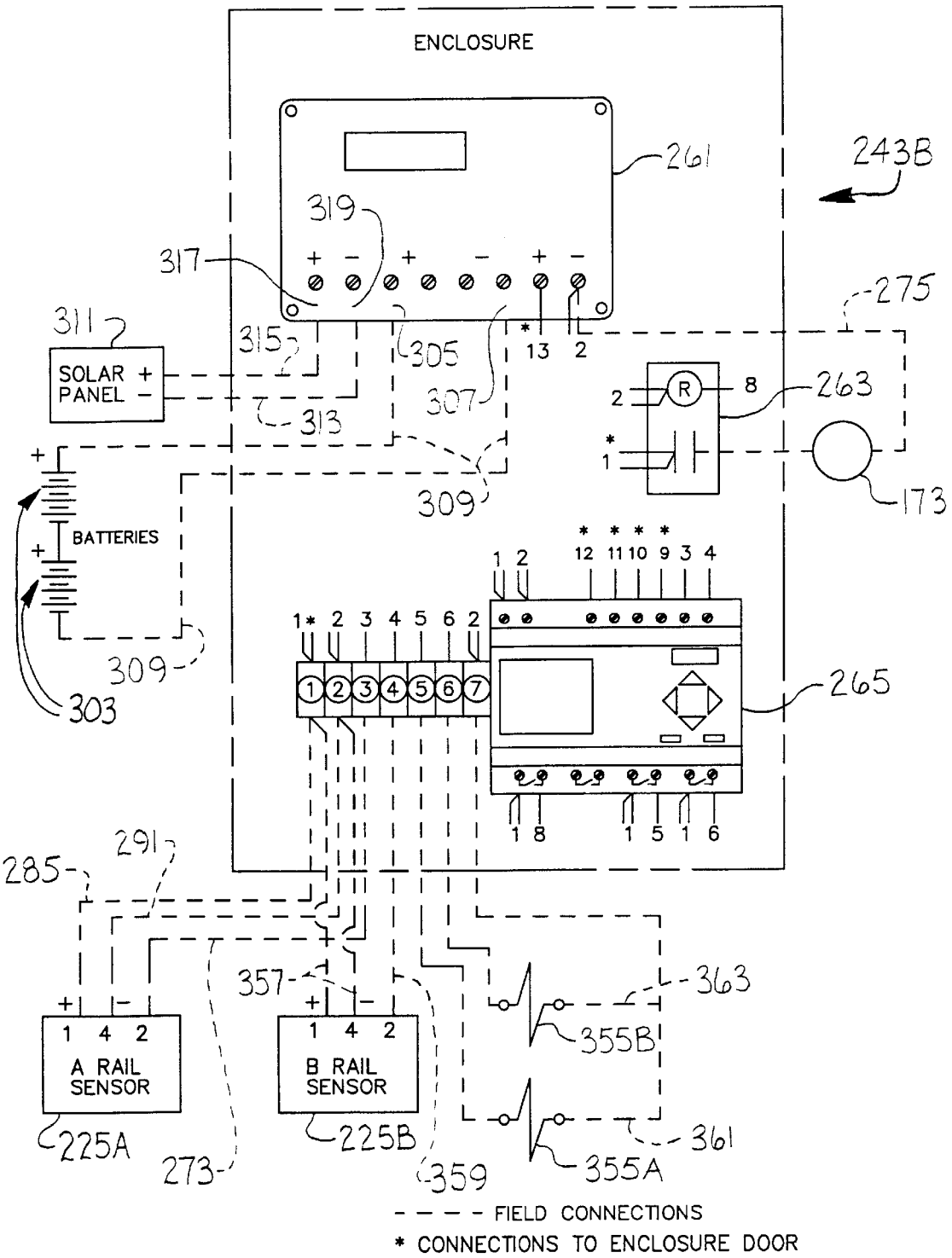
FIG. 29 is a view similar to FIGS. 24 and 26 showing a modification of the controller used in the dual track version.
Figure 30:
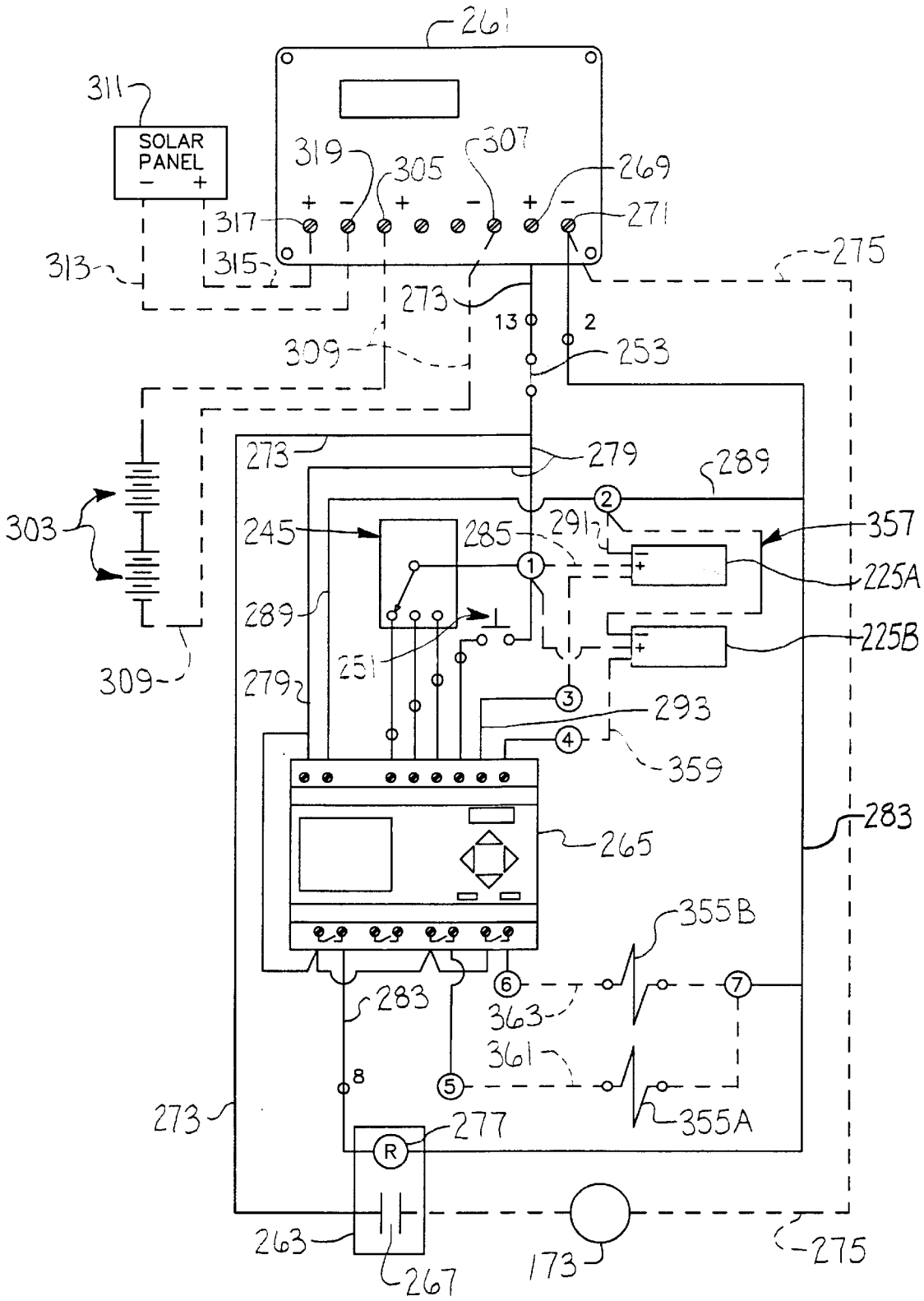
FIG. 30 is a wiring diagram showing the electrical system of the dual track version including the FIG. 29 controller.

FIG. 29 shows how controller 243 is modified for the dual-track version of the invention shown in FIG. 28, this modified version of the controller retaining the solar-charged-battery system, and being designated 243*b;* and FIG. 30 shows the wiring thereof. Thus, the track A sensor 225A is connected for receiving 24 VAC and transmitting a signal to the PLC 265 in the same manner as sensor 225. The track B sensor is powered via 24 VAC circuitry indicated at 357 and connected for transmission of its signal to the PLC 265 as indicated at 359. Solenoid valve 355A is connected in line 361 between PLC 265 and line 283; solenoid valve 355B is connected in line 363 between PLC 265 and line 283. Otherwise, the controller 243*b* and the wiring of the dual track solar-charged-battery-powered system are essentially identical to the controller 243 and wiring for the single track solar-charged-battery-powered system of FIGS. 25 and 26.

On transmission of a signal from sensor 225A to the PLC 265 that a train is passing thereover on track A, the solar-charged-battery-powered dual track system responds in the same manner as the single track solar-charged-battery-powered system with the concomitant closure of solenoid valve 355B via line 363 to close line 179B for delivery of lubricant under pressure via line 179A to master distributor 181 for track A, solenoid valve 355A remaining open for this delivery, thus providing lubrication for the rails of track A. On transmission of a signal from sensor 225B to PLC 265 that a train is passing thereover on track B, a reverse response is had with concomitant closure of solenoid valve 355A to close line 179A for delivery of lubricant under pressure via line 179B to master distributor 181 for track B, solenoid valve 355B remaining open for this delivery, thus providing lubrication for the rails of track B. On transmission of signals simultaneously from both sensors 225A and 225B that trains are passing over both at the same time, as programmed into the PLC 265 valves 335A and 335B are alternately closed for relatively short intervals of time for alternate delivery of lubricant to the distributors 181 for the two tracks for the lubrication of the rails of both tracks. For example, valve 335B is closed for a ten second interval for a ten second delivery to distributor 181 for track A; then valve 335A is closed for a ten second interval for a ten second delivery to distributor 181 for track B; then valve 335B is closed for a ten second interval for a ten second delivery to distributor 181 for track A, etc. This alternate distribution method is employed because the pump 165 may not have sufficient capacity to serve both tracks A and B at the same time.

Figure 31:
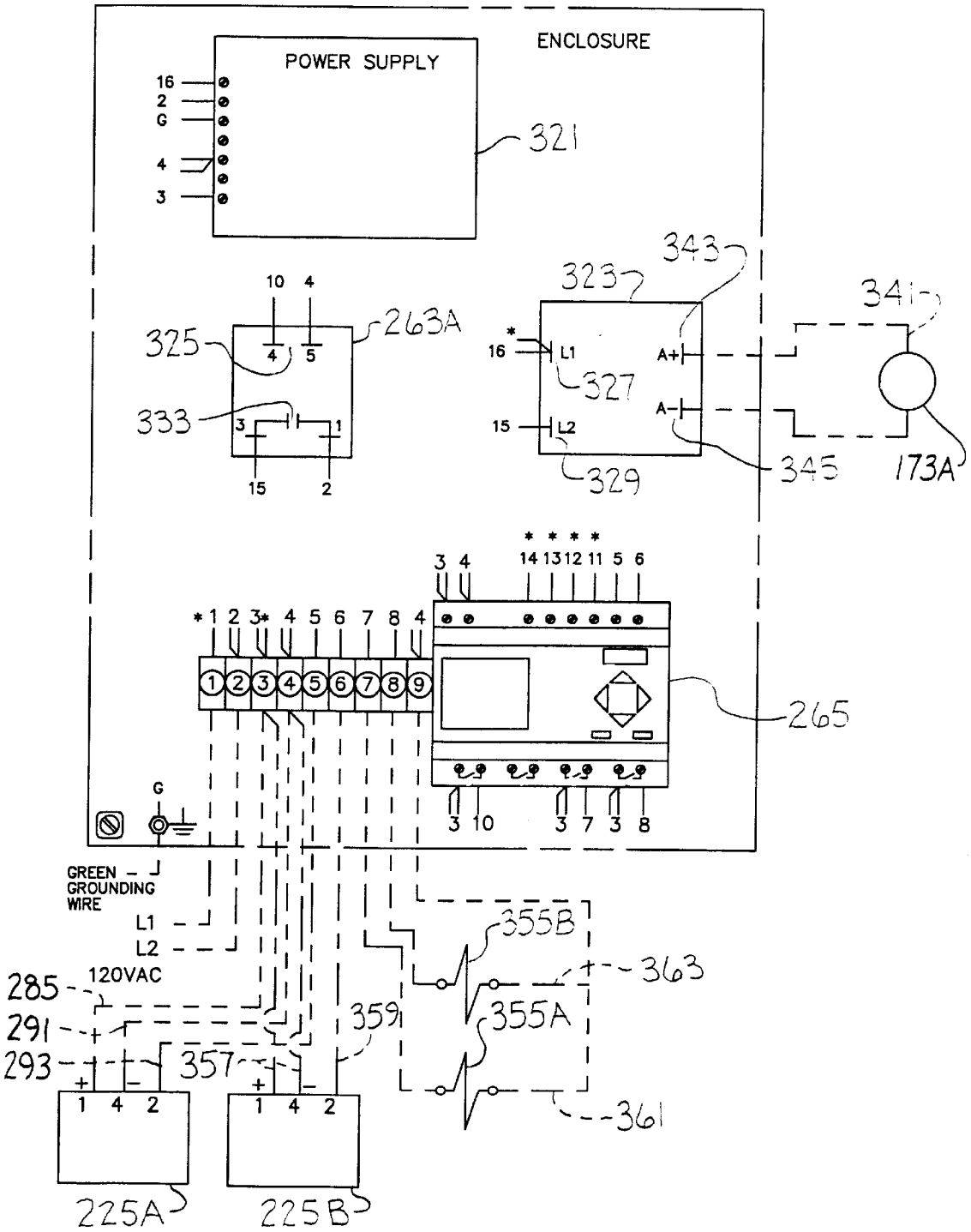
FIG. 31 is a view similar to FIG. 29 showing a modification of the FIG. 29 controller.
Figure 32:
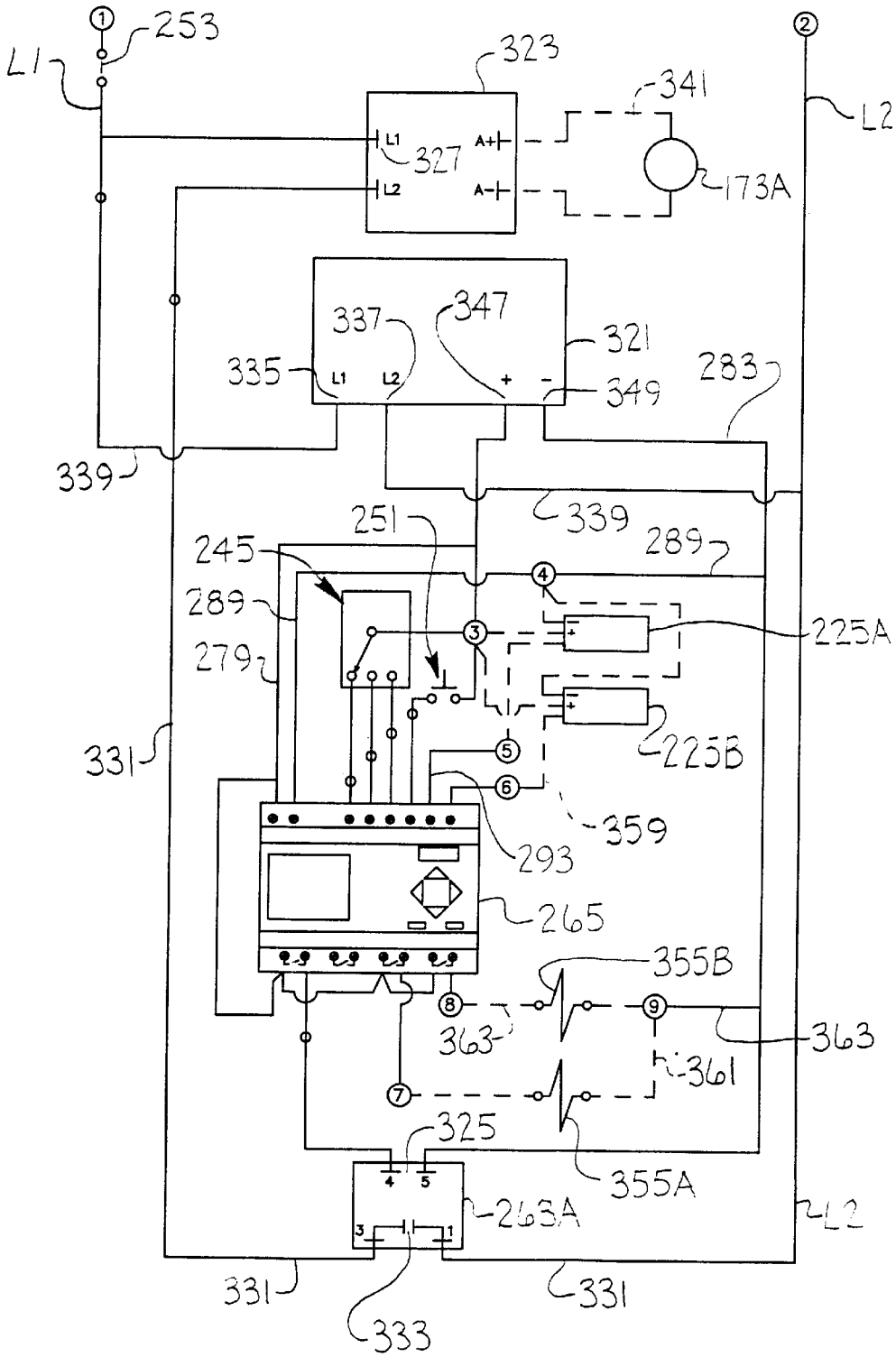
FIG. 32 is a wiring diagram showing a modification of the electrical system including the FIG. 31 controller.

FIGS. 31 and 32 illustrate a modification of the above-described solar-charged-battery-powered dual track version of the apparatus of this invention incorporating the 120 VAC power source feature of the FIGS. 26 and 27 single-track 120 VAC system instead of the solar-charged battery source. Otherwise, the FIGS. 31 and 32 modification is essentially the same as in FIGS. 29 and 30.

Figure 33:
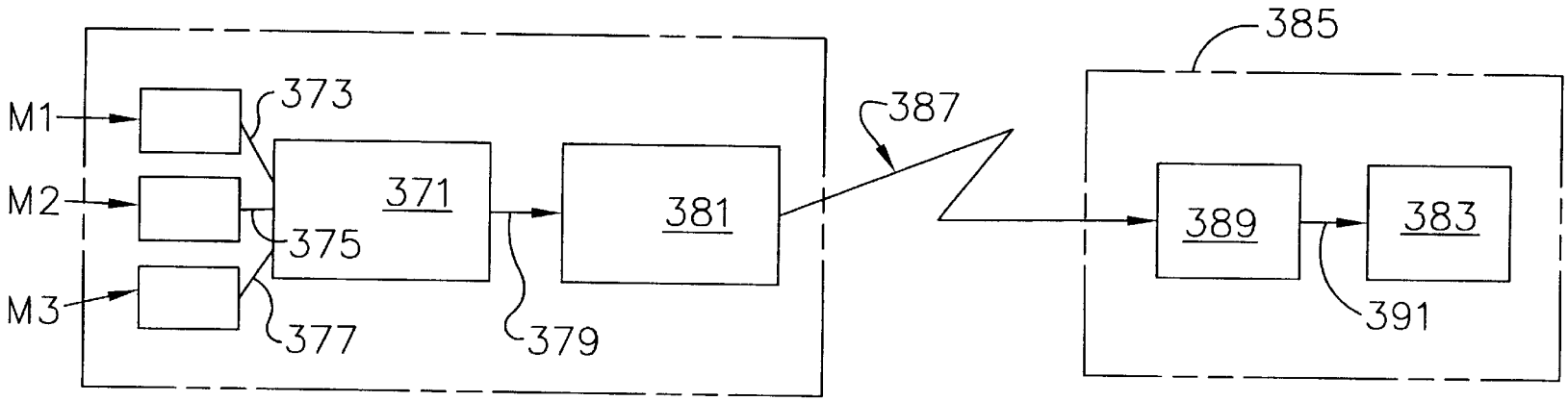
FIG. 33 is a diagram illustrating a first monitoring system of the invention.

FIG. 33 illustrates a system of this invention for carrying out a method of this invention for the monitoring of any of the wayside lubrication apparatus described above at a location remote from the site thereof, the concept being applicable to the remote monitoring of other apparatus. As shown in FIG. 33, three monitors M1, M2 and M3 are provided on site for monitoring three different parameters of the apparatus, M1 monitoring the cycling of the apparatus, M2 the level of lubricant in the drum 145, and M3 the voltage available from the batteries 303. Most important of these parameters is the cycling, for observation to make sure that the apparatus has been functioning; at least this one parameter should be monitored. A programmable logic controller 371 is provided on site (it may be housed in the housing 147) for receiving and transmitting data re the monitored parameters. This PLC 371 is a commercially available item, preferably a Simatic 57-200 PLC sold by Siemens AG, of Nuremberg, Germany, with a 222 CPU Monitor. Monitor M1 is the aforementioned sensor device 201 which, in effect, provides a count of the deliveries of lubricant to the applicators A1, A2 and transmits the count to the PLC 371 via a line 373. Monitor M2 is preferably an ultrasonic lubricant level sensor, being a commercially available item preferably a Sonar-BERO ultrasonic sensor sold by Siemens AG, of Nuremberg, Germany. It transmits data re the lubricant level to the PLC 371 via a line 375. Monitor M3 is a component of the power input unit 261 and transmits data re the battery charge to the PLC 371 via a line 377. The PLC 371 communicates the monitored data periodically, e.g. once a day, via a line 379 to a communications interface 381, from which the data is transmitted to a computer 383 at a location 385 remote from the site of the track lubrication apparatus. Computer 383 is, for example, a conventional personal computer (PC) adapted to receive data transmitted by the PLC 371. A transmission system for transmitting data via interface 381 from the on-site PLC 371 to the PC 383 at the remote location is indicated at 387. Where access to telephone lines is available at the site, interface 381 is a modem and the transmission system comprises telephone interconnection of modem 381 and modem 389 at the remote location, modem 389 being interconnected with PC 383 as indicated at 391.

Thus, periodically (e.g. once a day), the PC 383 at the remote location receives data re the number of times lubricant has been delivered to the applicators A1, A2 at the lubrication site in a predetermined time, data re the level of lubricant in the drum 145 and data re the battery charge at the time of receipt. The remote location may be, for example, an office of or affiliated with the vendor/installer of the apparatus (e.g., the assignee of this application), the railroad, or other entity responsible for maintaining and servicing the apparatus. Periodic readout from PC 383 of the data (e.g., daily readout) will show if maintenance or service is needed. Thus, if the readout shows a count of the cycles of distributor 181 to be lower than normal in the predetermined time, trouble would be suspected and attended to. If the readout shows that lubricant is needed in drum, a service call for replenishing the supply in the drum is in order. If the readout shows that the battery charge is low, on-site inspection would follow.

Figure 34:
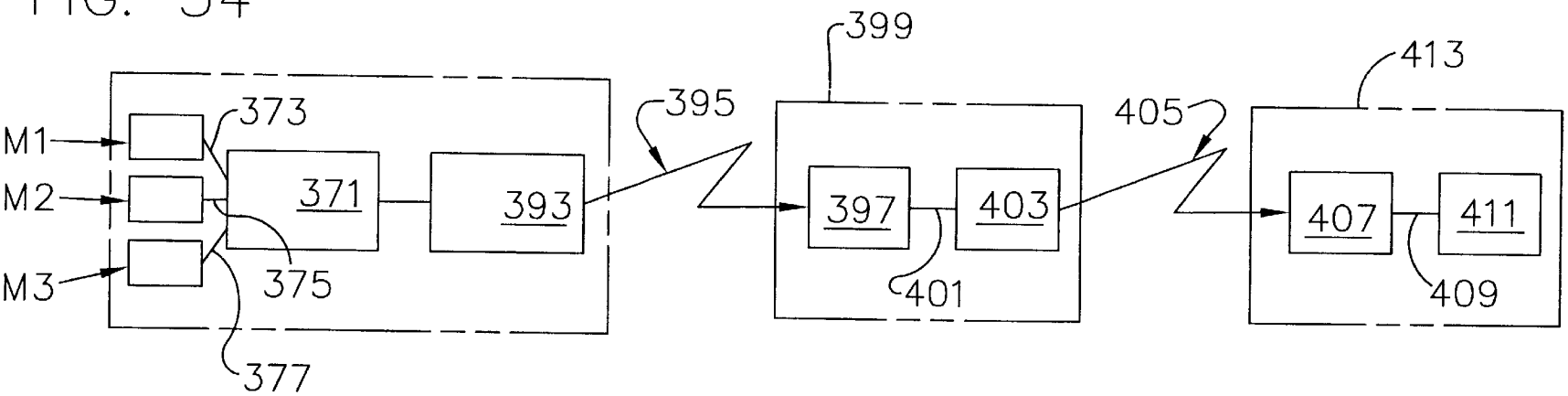
FIG. 34 is a diagram of a second monitoring system of the invention.

FIG. 34 illustrates a modification of the remote monitoring system which may be used where telephone service is not readily available, or not to be used, involving satellite communication instead of telephone line communication as in FIG. 33, and further involving enhanced communication of the monitored data. The same monitors M1, M2 and M3 may be used in conjunction with the same PLC 371, the latter communicating with a satellite communicator 393 for satellite transmission of the data as indicated at 395 to a central PC 397 at a central remote location 399 such as the website of the vendor/installer of the apparatus. The PC 397 is connected as indicated at 401 with a modem 403 which is interconnected via the Internet as indicated at 405 with modem 407 connected as indicated at 409 with a PC 411 at a remote branch location 413. It will be understood that there may be any number of such branch locations. The satellite communicator is a commercially available component, preferably an OBCOMM™ data communicator, Model KX-G7101, made by Kyushu Matsushita Electric Co., Ltd. of Fukuoka, Japan.

In view of the above, it will be seen that the several objects of the invention are achieved and other advantageous results attained.

As various changes could be made in the above constructions and method without departing from the scope of the invention, it is intended that all matter contained in the above description and shown in the accompanying drawings shall be interpreted as illustrative and not in a limiting sense.

What is claimed is:

1. Railroad rail head lubrication apparatus comprising:

an elongate applicator for attachment to a railroad rail on the inside of the rail extending lengthwise of the rail, said applicator having a lubricant flow divider comprising a group of lubricant metering devices, each of said metering devices comprising a divider valve operable in response to delivery thereto of lubricant under pressure to deliver a metered charge of lubricant and to become charged for a subsequent delivery of a metered charge, the metered charges delivered by said devices being delivered to points spaced at intervals along the length of the applicator with the delivery such as to apply the delivered charges to the inside of the head of the rail to which the applicator is attached.

2. Apparatus as set forth in claim 1 wherein said group of metering devices is located along the length of the applicator and delivery of lubricant from the group to said points is via delivery passages in the applicator.

3. Apparatus as set forth in claim 2 wherein certain of said delivery passages extend through the applicator in one direction lengthwise thereof and certain of said delivery passages extend through the applicator in the opposite direction.

4. Apparatus as set forth in claim 1 wherein two of said lubricant flow dividers are mounted in spaced relation along the length of the applicator, the delivery from each divider to the respective points being via delivery passages in the applicator.

5. Apparatus as set forth in claim 4 wherein certain of said delivery passages extend through the applicator from each group in one direction lengthwise of the applicator and certain of said delivery passages extend through the applicator from each group in the opposite direction.

6. Apparatus as set forth in claim 2 wherein each said divider valve has an inlet for admission of lubricant under pressure, an outlet in communication with a delivery passage in the applicator for delivery of the lubricant to one of said points, and a valve member moveable between a first position and a second position for delivery of a charge of the lubricant through said outlet.

7. Apparatus as set forth in claim 6 wherein certain of the delivery passages in the applicator extend therethrough in one direction lengthwise thereof and certain of the passages therein extend therethrough in the opposite direction.

8. Apparatus as set forth in claim 6 having two of said lubricant flow dividers mounted in spaced relation along the length of the applicator.

9. Apparatus as set forth in claim 8 wherein certain of said delivery passages extend through the applicator from each group in one direction lengthwise of the applicator and certain of said delivery passages extend through the applicator from each group in the opposite direction.

10. Apparatus as set forth in claim 6 wherein each said divider valve has transfer ports for interconnection of the valves in the series, and transfer passages for interconnecting said transfer ports of the valves, the valve members being successively moveable in response to delivery of lubricant under pressure through the inlets and via communication between the valves established by the valve members and said transfer ports and transfer passages to deliver charges of the lubricant through the outlets in a sequence.

11. Apparatus as set forth in claim 10 wherein certain of the delivery passages in the applicator extend therethrough in one direction lengthwise thereof and certain of the passages therein extend therethrough in the opposite direction.

12. Apparatus as set forth in claim 10 having two of said lubricant flow dividers mounted in spaced relation along the length of the applicator.

13. Apparatus as set forth in claim 12 wherein certain of said delivery passages extend through the applicator from each group in one direction lengthwise of the applicator and certain of said delivery passages extend through the applicator from each group in the opposite direction.

14. Apparatus as set forth in claim 10 wherein each said divider valve has a bore and said valve member is a valve spool axially slidable in the bore, the spool being movable from a first position at one end of the bore to a second position at the other end of the bore to deliver a metered charge of lubricant out of said other end of the bore and thence through an outlet, and being movable back to first position to deliver a metered charge of lubricant out of said one end of the bore and thence through an outlet, the series of valves including a first valve and a last valve and being operable in a sequence wherein the spools are moved from said first to said second position and then moved back to said first position in sequence, ending with the last valve.

15. Apparatus as set forth in claim 14 wherein certain of the delivery passages in the applicator extend therethrough in one direction lengthwise thereof and certain of the passage in the applicator extend therethrough in the opposite direction.

16. Apparatus as set forth in claim 14 having two of said lubricant flow dividers mounted in spaced relation along the length of the applicator.

17. Apparatus as set forth in claim 16 wherein certain of said delivery passages extend through the applicator from each group in one direction lengthwise of the applicator and certain of said delivery passages extend through the applicator from each group in the opposite direction.

18. Apparatus as set forth in claim 1 wherein said applicator comprises an elongate mounting bar for attachment at the ends thereof on the rail and at least one distributor extending lengthwise of the bar having passages therein for the delivery of said metered charges of lubricant from said metering devices to said points.

19. Apparatus as set forth in claim 1 wherein said applicator comprises an elongate mounting bar for attachment at the ends thereof on the rail, two elongate distributors extending in tandem lengthwise of the bar, each distributor having at least one said lubricant flow divider serving passages in the respective distributor for the delivery of said metered charges of lubricant from said metering devices to said points.

20. Apparatus as set forth in claim 1 wherein each distributor comprises a laminated assembly of plates on one face of the mounting bar, one of said plates being formed to provide said delivery passages.

21. Apparatus as set forth in claim 20 wherein each said lubricant flow divider is on the other face of the mounting bar with outlets thereof in communication with said delivery passages through holes in the mounting bar.

22. Apparatus as set forth in claim 21 wherein said one plate is formed to provide said delivery passages by having slots therein and said assembly comprises a closure plate on the outside of said one plate and a spacer plate between the mounting bar and said one plate.

23. Apparatus for applying lubricant to the inside of the head of a rail of a railroad track comprising:

an elongate applicator for said delivery of lubricant, said applicator including an elongate mounting bar, a lubricant flow divider comprising a group of lubricant metering devices, each metering device comprising a divder valve, mounting means at each end of the mounting bar for mounting said applicator in position extending lengthwise of the rail on the inside thereof, each said mounting means comprising a first rail flange clamp jaw engaging an inside edge of a flange of the rail and a second rail flange clamp jaw engaging an outside edge of the flange, said jaws being drawn together for the clamping thereof on the flange, and a support for the mounting bar on the first jaw.

24. Apparatus for applying lubricant to the insides of the heads of the rails of a railroad track, each rail having one or more elongate applicators extending lengthwise on the inside thereof for delivery via passages in said one or more applicators of metered charges of lubricant to points spaced at intervals along the insides of the heads of the rails, a lubricant flow divider comprising a group of lubricant metering devices, each metering device comprising a divider valve, a container for holding a supply of lubricant alongside the track, and a pump for pumping lubricant from the container to said metering devices in response to passage of a train on the track.

25. Apparatus as set forth in claim 24 wherein each applicator extends for a distance corresponding to about the circumference of a standard railroad car wheel.

26. Apparatus as set forth in claim 25 wherein said one or more applicators comprises two applicators in tandem each comprising an elongate mounting bar mounted on the respective rail and two elongate distributors extending in tandem lengthwise of the bar, each of said distributors having said passages therein.

27. Apparatus as set forth in claim 24 having an electric motor for driving the pump, said motor being connected in an electrical circuit responsive to passage of a train on the track for operation of the motor to drive the pump.

28. Apparatus as set forth in claim 27 having a sensor on the track for sensing passage of a train on the track and transmitting a signal to said motor circuit for said responsive operation thereof.

29. Apparatus as set forth in claim 28 having a controller in said circuit for maintaining the motor in operation at least for a predetermined time after receiving a signal.

30. Apparatus as set forth in claim 28 having a controller in said circuit including a pump duty cycle switch for setting the apparatus for cycling of the pump at one of a number of different rates.

31. Apparatus as set forth in claim 27 having at least one battery for supplying electric power to the motor and a solar panel for charging the battery.

32. Apparatus as set forth in claim 27 wherein said motor is a DC motor and wherein DC power is supplied thereto from an AC power source via an inverter.

33. Apparatus as set forth in claim 24 wherein each applicator comprises an elongate mounting bar mounted on the respective rail, at least one distributor extending lengthwise of the bar, said distributor having at least one said lubricant flow divider thereon serving said passages therein for the delivery of said metered charges of lubricant from said metering devices to said points.

34. Apparatus as set forth in claim 24 wherein the distributor is on one face of the mounting bar and said lubricant flow divider is on an opposite face.

35. Apparatus for applying lubricant to the inside of the heads of the rails of a railroad track comprising:

at least one lubricant applicator on the inside of each rail for delivery of lubricant to the inside of the heads of the rails;

a lubricant flow divider comprising a group of lubricant metering devices, each metering device comprising a divider valve;

a container for holding a supply of lubricant alongside the track;

a pump for pumping lubricant from the container to the applicator;

a electric motor for driving the pump;

said motor being connected in an electrical circuit responsive to passage of a train on the track for operation of the motor to drive the pump.

36. Apparatus as set forth in claim 35 wherein each applicator is operable upon delivery by the pump of lubricant to deliver charges of lubricant to points spaced at intervals along the length of the rails.

37. Apparatus as set forth in claim 35 including a sensor on the track for sensing passage of a train on the track and transmitting a signal to said motor circuit for said responsive operation thereof.

38. Apparatus for applying lubricant to the insides of the heads of the rails of adjacent first and second railroad tracks comprising, at least one lubricant applicator on the inside of each rail of the two tracks for delivery of lubricant to the insides of the heads of the rails of the tracks, a lubricant flow divider comprising a group of lubricant metering devices, each metering device comprising a divider valve, a container for holding a supply of lubricant adjacent the tracks, and a pump for pumping lubricant from the container to the applicators for the rails of the first track responsive to passage of a train on said first track, for pumping lubricant from the container to the applicators for the rails of the second track responsive to passage of a train on said second track, and for pumping lubricant from the container to the applicators for the rails of both tracks responsive to passage of trains on both tracks.

39. Apparatus for applying lubricant to the insides of the heads of the rails of adjacent first and second railroad tracks comprising, at least one lubricant applicator on the inside of each rail of the two tracks for delivery of lubricant to the insides of the heads of the rails of the tracks, a container for holding a supply of lubricant adjacent the tracks, a pump for pumping lubricant from the container to the applicators for the rails of the first track responsive to passage of a train on said first track, for pumping lubricant from the container to the applicators for the rails of the second track responsive to passage of a train on said second track, and for pumping lubricant from the container to the applicators for the rails of both tracks responsive to passage of trains on both tracks, and a first lubricant line served by the pump for serving the applicators for the rails of the first track and a second lubricant line served by the pump for serving the applicators for the rails of the second track, delivery responsive to passage of trains on both tracks being alternated via said lines.

40. Apparatus as set forth in claim 39 wherein each line has a distribution valve therein, the distribution valve in the second line being closed and the distribution valve in the first being open in response to passage of a train on the first track for delivery of lubricant to the applicators on the first track, the distribution valve in the first line being closed and the distribution valve in the second line being open in response to passage of a train on the second track for delivery of lubricant to the applicators on the second track, the distribution valves being alternately open and closed in response to passage of trains on both tracks for said alternated delivery to the lines.

41. Apparatus as set forth in claim 40 having an electric motor for driving the pump, two sensors, one on each track, each sensing passage of a train on the respective track and transmitting a signal responsive thereto, said distribution valves being solenoid valves, said motor and said distribution valves being responsive to the signal transmitted by one or the other sensor.

42. Apparatus as set forth in claim 41 wherein the distribution valves are normally open, the distribution valve in the second line closing on transmission of a signal from the sensor on the first track, the distribution valve in the first line closing on transmission of a signal from the sensor on the second track, the distribution valves closing in alternation on transmission of signals from both sensors.

43. Apparatus as set forth in claim 41 having at least one battery for supplying electric power to the motor and distribution valves and a solar panel for charging the battery.

44. Apparatus as set forth in claim 41 wherein said motor is a DC motor and said distribution valves are DC valves and wherein DC power is supplied thereto from an AC power source via an inverter.

45. Apparatus as set forth in claim 38 wherein each applicator comprises an elongate mounting bar mounted on the respective rail, and at least one distributor extending lengthwise of the bar, said distributor having at least one said lubricant flow divider thereon serving passages in the distributor for the delivery of said metered charges of lubricant from said metering devices to a respective rail.

* * * * *